United States Patent [19]

Resch et al.

[11] 4,299,388

[45] Nov. 10, 1981

[54] APPARATUS FOR CONTROLLING A REELED CHANCE BASED AMUSEMENT DEVICE

[75] Inventors: David Resch; Gregory Nanus, both of Las Vegas, Nev.

[73] Assignee: Concorde Manufacturing Company, Las Vegas, Nev.

[21] Appl. No.: 50,364

[22] Filed: Jun. 20, 1979

[51] Int. Cl.[3] ..... A63F 5/04

[52] U.S. Cl. ..... 273/143 R; 273/138 A

[58] Field of Search ..... 235/92 GA; 273/138 A, 273/143 R, 143 C, 1 E, 139; 340/323 R

[56] References Cited

U.S. PATENT DOCUMENTS

| | | | |
|---|---|---|---|
| 3,269,503 | 8/1966 | Foster | 273/138 A |
| 3,533,629 | 10/1970 | Raven | 273/138 A |
| 3,556,531 | 1/1971 | Elder | 273/143 R |
| 3,606,337 | 9/1971 | Larsen et al. | 273/143 R |
| 3,642,287 | 2/1972 | Lally et al. . | |
| 3,684,290 | 8/1972 | Wayne | 273/143 C |
| 3,770,269 | 11/1973 | Elder | 273/138 A |
| 3,834,712 | 9/1974 | Cox | 273/143 R |
| 3,876,208 | 4/1975 | Wachtler | 273/138 A |
| 4,072,930 | 2/1978 | Lucero et al. | 235/92 GA |
| 4,099,722 | 7/1978 | Rodesch et al. | 273/143 R |

*Primary Examiner*—Vance Y. Hum

[57] ABSTRACT

Apparatus for controlling a gaming device including a plurality of rotatable reels provided with indicia has an input circuit associated with the reels for detecting reel positions at every instant in time. A computing circuit is connected to the input circuit for receiving reel position signals and maintaining data on reel positions. Connected to the computing circuit is a comparative, or win, circuit arranged for receiving reel position signals from the computing circuit and for comparing indicia on each of the reels as a function of the position of the reels for determining if a predetermined match exists. A pay circuit connected to the comparative circuit is actuated by a match detected in the comparative circuit to effect a pay-out by a hopper assembly of the associated gaming device. Included in the input circuit is an optical sensing assembly arranged for cooperating with gaps and openings provided on the reels for determining positions of the reels. The indicia provided on the reels forms a plurality of discrete symbols, with each of the symbols being associated with their respective position of the associated reel. A strip decode circuit is provided for grouping signals received from the computing circuit as a function of common ones of these symbols with a line select circuit determining wins, whether the device is set for multiple odds or multiple line wins.

14 Claims, 18 Drawing Figures

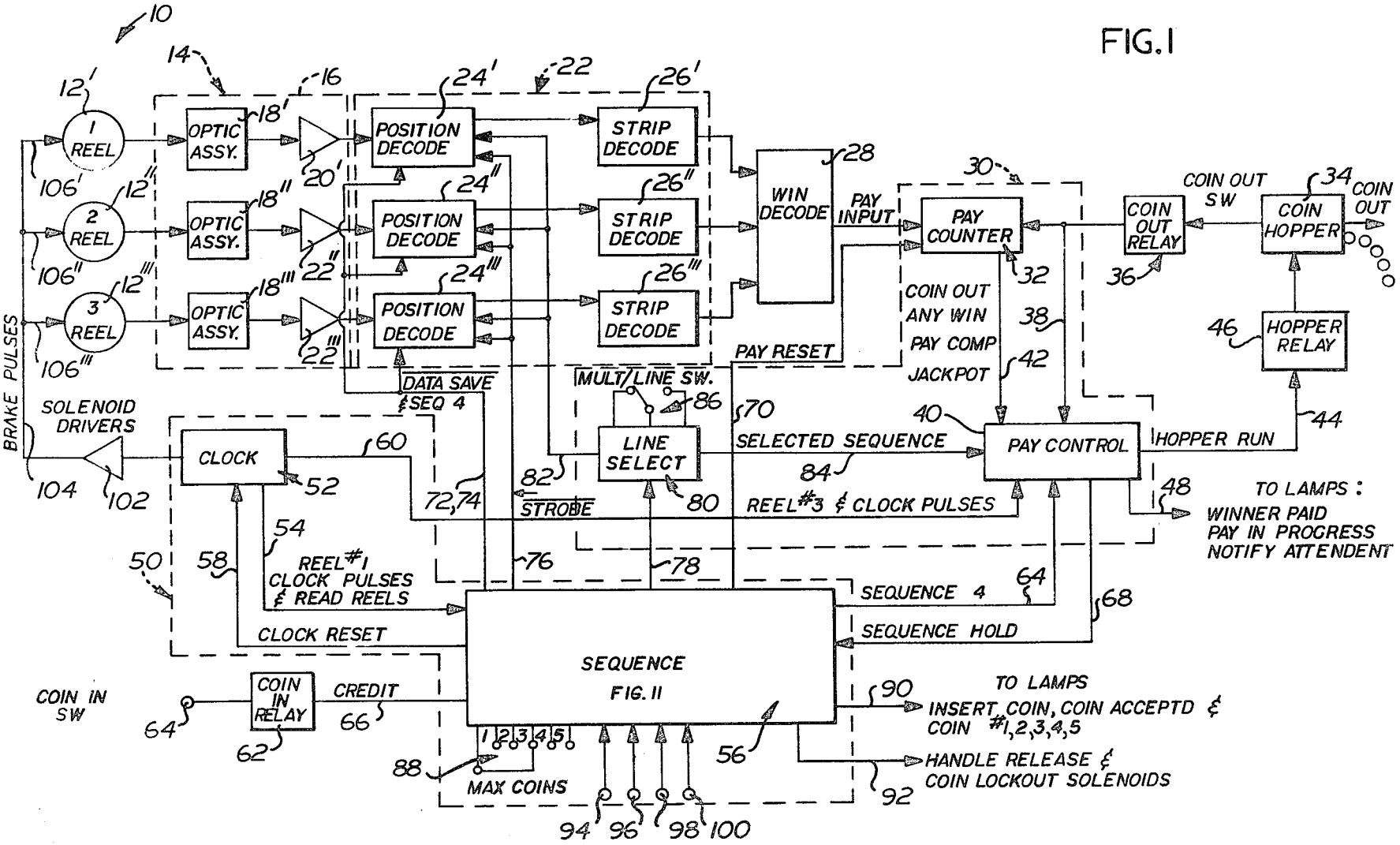
FIG. 1
COIN OUT
COIN HOPPER
HOPPER RELAY
COIN OUT SW
COIN OUT RELAY
HOPPER RUN
TO LAMPS: WINNER PAID PAY IN PROGRESS NOTIFY ATTENDENT
PAY COUNTER
PAY CONTROL
COIN OUT
ANY WIN
PAY COMP
JACKPOT
PAY INPUT
WIN DECODE
PAY RESET
SELECTED SEQUENCE
REEL #3 & CLOCK PULSES
SEQUENCE 4
SEQUENCE HOLD
TO LAMPS
INSERT COIN, COIN ACCEPTD & COIN #1,2,3,4,5
HANDLE RELEASE & COIN LOCKOUT SOLENOIDS
STRIP DECODE
MULT/LINE SW.
LINE SELECT
STROBE
SEQUENCE FIG. II
MAX COINS
POSITION DECODE
DATA SAVE & SEQ 4
OPTIC ASSY.
CLOCK
REEL #1 CLOCK PULSES & READ REELS
CLOCK RESET
CREDIT
COIN IN RELAY
1 REEL
2 REEL
3 REEL
SOLENOID DRIVERS
BRAKE PULSES
COIN IN SW SYMBOL DECODE MATRIX
DECODED STRIP SYMBOLS
"A" "B" "C" --N
RA--RN 82 K Ω
BINARY DECODER
STRIP POSITION
24', 24'', 24'''
DATA SELECTOR
SHIFT REGISTER
BINARY COUNTER
LOAD
COUNT
COUNT LOAD
STROBE
DATA SELECT
DATA SAVE
(SEQ. 4,5,6,7,8,9,10)
INDEX SEQ.4
RESET

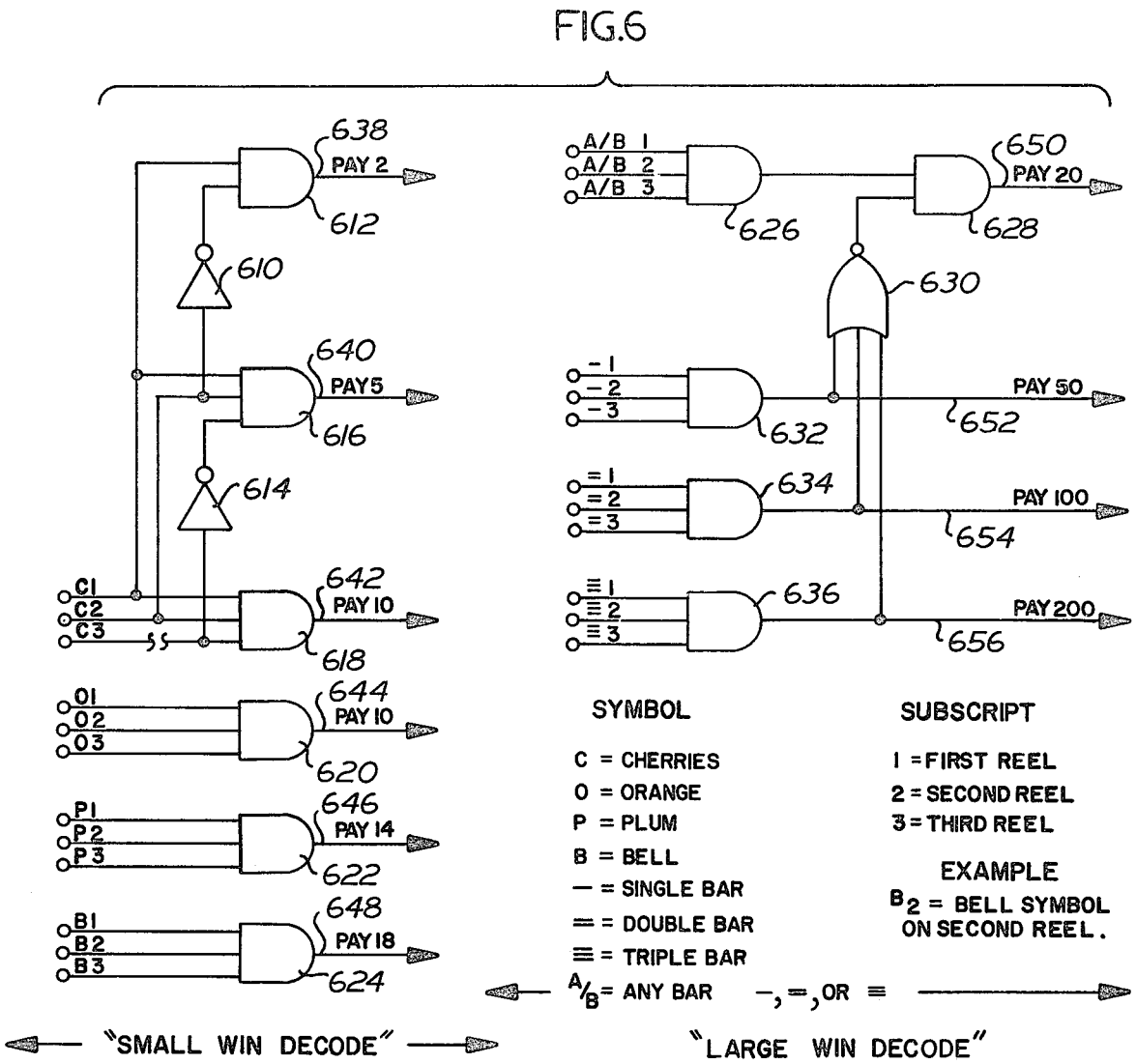
FIG.6
650
PAY 20
628
630
626
A/B 1
A/B 2
A/B 3
PAY 50
652
PAY 100
654
PAY 200
656
632
634
636
638
PAY 2
612
610
640
PAY 5
616
614
642
PAY 10
618
644
PAY 10
620
646
PAY 14
622
648
PAY 18
624
C1
C2
C3
O1
O2
O3
P1
P2
P3
B1
B2
B3
SYMBOL
C = CHERRIES
O = ORANGE
P = PLUM
B = BELL
— = SINGLE BAR
= = DOUBLE BAR
≡ = TRIPLE BAR
A/B = ANY BAR
—, =, OR ≡
SUBSCRIPT
1 = FIRST REEL
2 = SECOND REEL
3 = THIRD REEL
EXAMPLE
B2 = BELL SYMBOL ON SECOND REEL.
"LARGE WIN DECODE"
"SMALL WIN DECODE"

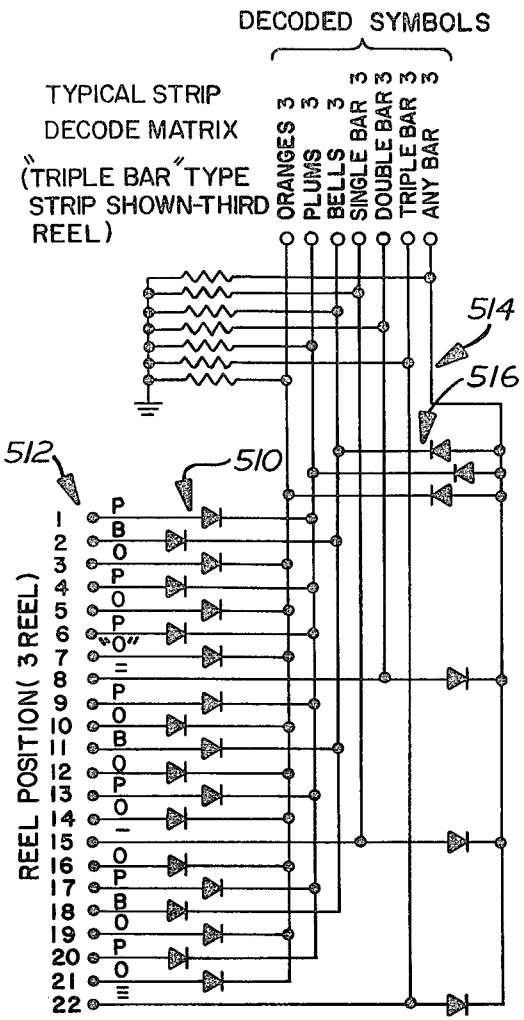
FIG.5
DECODED SYMBOLS
ORANGES
PLUMS
BELLS
SINGLE BAR
DOUBLE BAR
TRIPLE BAR
ANY BAR
TYPICAL STRIP DECODE MATRIX
"TRIPLE BAR" TYPE STRIP SHOWN-THIRD REEL)
514
516
510
512
REEL POSITION( 3 REEL)

APPARATUS FOR CONTROLLING A REELED CHANCE BASED AMUSEMENT DEVICE

CROSS REFERENCE TO A RELATED APPLICATION

This invention is related to the commonly owned application Ser. No. 06/038618 filed May 14, 1979, now U.S. Pat. No. 4,249,737.

BACKGROUND OF THE INVENTION

1. Field of the Invention

This invention relates generally to gaming or amusement devices of the kind relying on the principles of chance to determine winners, and particularly to electronic control circuits for such devices.

2. Description of the Prior Art

A very popular form of gaming involves the use of a chance amusement device generally referred to as a slot machine. These devices usually are provided with a display formed by a plurality of rotatable reels set in motion by manual actuation of a handle provided on the machine. The plurality of reels are themselves provided with indicia in the form of symbols of fruit: such as oranges, plums and the like; with a winner being determined by certain combinations of the symbols appearing in one or more horizontal lines of a display area of the device.

An example of an amusement and game apparatus employing a set of symbol-bearing reels, together with the mechanism for spinning and indexing the reels, can be found in U.S. Pat. No. 3,642,287, issued Feb. 15, 1972 to J. E. Lally, et al.

Although these gaming devices were originally entirely mechanical in construction, employing a great number of intricate mechanisms to randomly arrest the rotating reels, determine winners, and effect pay-out, in recent years various proposals have been made for controlling chance gaming devices such as these by use of electronic logic control systems. Examples of logic control systems intended for use with plural reel chance devices can be found in U.S. Pat. Nos: 3,439,281, issued Apr. 15, 1969 to J. F. McGuire, et al.; 3,684,290, issued Aug. 15, 1972 to R. G. Wayne, et al.; and 3,834,712, issued Sept. 10, 1974, to C. H. Cox.

U.S. Pat. No. 3,269,503, issued Aug. 30, 1969 C. E. Foster, discloses an electronic logic system employed for deriving and accumulating jackpots for poker, fruit and other like gaming machines.

SUMMARY OF THE INVENTION

It is the object of the present invention to provide an electronic control system for rotatable reel gaming devices wherein a reel position sensing system is provided which is simple of construction and installation, and is extremely non-critical as to adjustment.

It is a further object of the present invention to provide an electronic control system for gaming devices wherein the system is capable of maintaining data on multiple pay lines while using a very simple single line reel position detecting assembly, has an output format compatable with conventional data processing equipment, and can be readily expanded to handle any number of reel stop stations.

A still further object of the present invention is to provide an electronic control system for gaming devices employing rotatable reels wherein the production of any desired reel strip/percentage arrangement is simplified when compared with known systems, with the system being further able to perform such functions as "any Bar" and "symbol-symbol-Bar" logic to determine a winner.

A still further object of the present invention is to provide an electronic control system for a rotatable reel gaming device in which the amount and manner of pay-out is variable in a simple manner so as to permit different pay-out amounts or win combinations, one point increments of number of coins paid per win combination, the ability to multiply a basic winning amount by "odds" in a multiplier type format, the ability to selectively cancel one pay-out in favor of another (that is, "matched bars" will cancel out "any bars".), and the ability to permit the operator of the device to select payment of a jackpot by hand rather than automatically.

Yet another object of the present invention is to provide an electronic control system for rotatable reels gaming devices in which the number of coins playable in a multiple coin format machine can be easily varied, and in which the "odds" being used can be searched and paid in any order. (That is, lock-up on hand pay jackpots immediately, or the machine pays the first coin odds before machine lock-up.)

A still further object of the present invention is to provide an electronic control system for rotatable reels gaming devices wherein the system will permit pay-outs sequentially rather than simultaneously, thereby eliminating constraints on the strip lay-out of the system.

Yet another object of the present invention is to provide an electronic control system for rotatable reel gaming devices wherein the system permits seeking of a "last coin line" last in order to allow automatic pays prior to any handpay jackpot lock-up by the machine.

Another object of the present invention is to provide an electronic control system for rotatable reel gaming devices wherein the control system ignores inputs that do not occur at the proper time or in a prescribed sequence for the machine.

A still further object of the present invention is to provide an electronic control system for rotatable reel gaming devices wherein the spin-time of all reels of the device can be adjusted in a simple manner.

These and other objects are achieved according to the present invention by providing an electronic control system for plural rotatable reel gaming devices wherein the system has: an input circuit associated with the reels of a gaming or amusement device for detecting position of the rotating reels; a computing circuit connected to the input circuit for receiving reel position signals from the input circuit and maintaining data on position of the reels; a comparator circuit connected to the computing circuit for receiving reel position signals from the computing circuit and comparing indicia on each of the reels as a function of the position of the reels and determining if their exists a predetermined match between the indicia of the reels and a pay circuit connected to the comparator means for effecting a pay-out when predetermined matches of the indicia on the reel is found to exist by the comparator circuit.

The input circuit includes a sensing assembly associated with the reels so as to cooperate with gaps and holes provided in the reels and transmit signals to pulse shapers also forming part of the input circuit and connected to the sensing assembly and to the computing circuit for receiving signals from the sensing assembly and conditioning the signals for feed into the computing circuit. More specifically, the sensing assembly includes a plurality of sensing units, one for each of the plurality of reels of the associated gaming device.

In particular it is contemplated that each sensing unit of the sensing assembly will comprise a radiation emitting and a radiation receiving part, with it being specifically contemplated that an LED will be employed to emit light in blocked and unblocked sequence through the gaps and holes provided in the associated rotating reel to a phototransistor.

The computing circuit includes an index logic circuit connected to the input circuit for receiving reel position data therefrom and processing the data received to determine pay lines. The computing circuit also includes a strip circuit connected to the index circuit and to the comparator circuit for receiving a signal from the index circuit and converting data contained in the signal into a common symbol output decoded parallel data line arrangement for being fed into the comparator circuit.

The index circuit includes, according to a preferred embodiment of the invention, a plurality of position decode circuits, one such decode circuit for each of the reels of the associated gaming device. Each of these position decode circuits comprises a counter connected to an associated one of the pulse shapers of the input circuit for receiving therefrom a signal which is a function of the position of an associated one of the reels of the gaming device. A shift register is connected to the counter for storing current and, for example, three previous reel positions data, with a data selecter being connected to the shift register for routing data from the shift register to the strip circuit of the index circuit. A digital, usually binary, decoder is connected to the data selecter and to the strip circuit associated with the decoder for converting signals received from the data selecter into a reel position signal which is a function of symbols formed by the indicia provided on the reels of the gaming device. More specifically, the decoder changes the coded signal received from the data selecter into a parallel output including as many lines as there are stop stations associated with the reel whose position is being monitored.

A preferred embodiment of the pay circuit includes a counter connected to the comparative circuit for processing data received from the comparator circuit and to a "coin-out" switch of the gaming device; which counter determines the presence of a win and completion of the pay-out for a win. Further, the pay circuit includes a pay control unit connected to the pay counter, the pay control unit being connectible to a coin hopper of an associated gaming device for actuating the hopper or other coin dispensing device.

A line circuit is advantageously connected to the sequence unit and to the index circuit for selecting, in sequence, one or more pay lines for determination of wins. The number of different pay lines in play or the number of times a certain line repeatedly is selected, is determined by the number of coins, or tokens, to be played.

A timing circuit which includes a clock and a sequence circuit, is connected to the pay circuit and index circuit for coordinating functions of the control system. The clock is arranged for generating a pseudo-random pulse train for the indexing of the reels, while the sequencer is connected to the clock, the computing circuit, and the pay circuits for controlling all functions of the system and therefore the associated gaming device. The clock supplies clocking pulses to the sequencer for synchronizing the out-put of control signals by the sequencer.

A particularly advantageous feature of the present invention is the section of the system which permits coded digital, usually binary, data from plural sources to be converted into a code supplying information related to predetermined categories. This portion of the system includes the decoders which are connected to plural sources of digital data for decoding the data into individual signals, and a matrix, preferably a diode matrix, connected to the decoder for receiving the individual signals and routing the signals to lines representing common ones of the predetermined categories.

Another particularly advantageous feature of the present invention is the apparatus for sensing the instantaneous position and movement of the rotatable bodies, or reels, of the gaming device. This apparatus includes sensing units associated with the rotatable bodies for creating pulses by interruptions in the bodies. Specifically, these interruptions can be caused by gaps formed in the periphery of the reels, and by at least one hole provided in the reel for measuring revolutions of the reel.

BRIEF DESCRIPTION OF THE DRAWINGS

FIG. 1 is a block diagram showing the overall electronic control system according to present invention.

FIGS. 4A, 4B and 5 are schematic diagrams showing typical strip decode circuits for use with the three reels shown in the block diagram of FIG. 1 to convert data received from the computing logic circuit shown in FIG. 3A into a code based on predetermined symbols appearing on the periphery of the reels of the associated gaming device.

FIG. 6 is a logic diagram showing a comparator, or win, decode circuit according to present invention.

DESCRIPTION OF THE PREFERRED EMBODIMENT

Figure 2B:
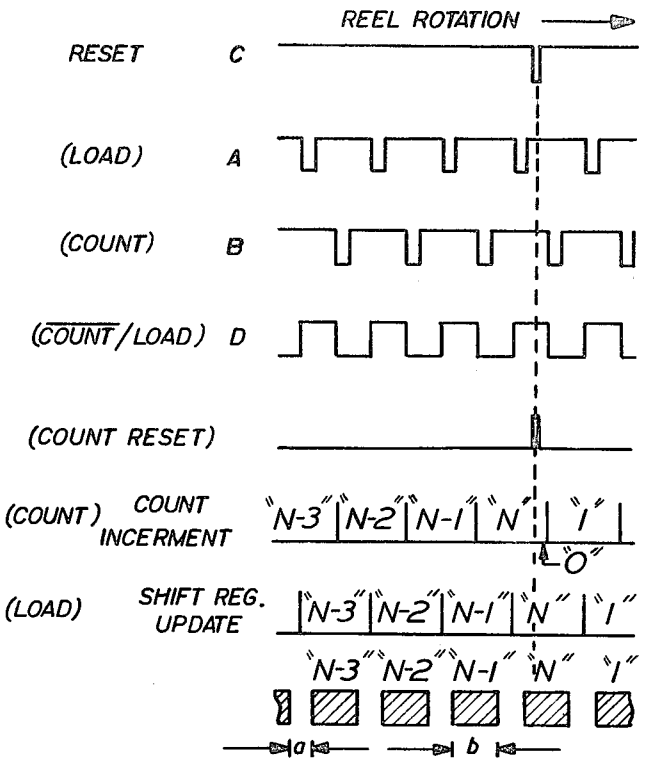
FIG. 2B is a timing diagram for the apparatus shown in FIG. 2A.

Referring now more particularly to FIG. 1 of the drawings, there is illustrated in block form a gaming device ten (10) including a plurality of rotatable reels, 12', 12'', and 12''' each provided with indicia in the form of discrete symbols. Such gaming devices are generally known, with the control circuit according to present invention, and to be described below, specifically intended for use with the gaming device disclosed in application Ser. No. 38,618, filed May 14, 1979, and commonly owned herewith.

The electronic control system associated with gaming device 10 which system is generally designated as 14, includes an input circuit 16 associated with reels 12', 12'', and 12''' of device 10 for detecting the position of the reels. This input circuit 16 includes a plurality of sensing assemblies 18', 18'', 18'''; one such assembly for each of the reels, 12', 12'', and 12''' for detecting the instantaneous positions of the rotating reels. These sensing assemblies 18', 18'', 18''', are preferably optical units as well as described below. Input Circuit 16 also includes a plurality of pulse shapers 20', 20'', 20''', connected to assemblies 18', 18'', 18''', respectively, and to a computing logic circuit 22 for receiving signals from the assemblies 18', 18'', 18''' and conditioning these signals for feed into the computing logic circuit 22.

As mentioned above, computing logic circuit 22 is connected to input circuit 14, specifically to the pulse shapers 20', 20'', and 20''', and is arranged for receiving reel position signals from circuit 14 for maintaining data on position of the reels 12', 12'', and 12'''.

It will be appreciated that while three reels are illustrated in FIG. 1, different numbers of reels can be employed as desired.

Computing logic circuit 22 includes a plurality of position decodes 24', 24'', and 24''', connected directly to the pulse shapers 20', 20'', 20''', respectively, to form an index circuit which receives reel position data from the input circuit 14 and processes this data to determine reel positions for machine or device 10. Circuit 22 also includes a plurality of strip decodes 26', 26'', and 26''', which are connected to the position decodes 24', 24'', and 24''', respectively, for receiving a signal from the index circuit performed by the position decode 24', 24'', and 24''', and converting data contained in the signal into a symbol output, the decoded data being fed into a comparator circuit, or win decode, designated 28.

The comparator circuit 28 is connected to the computing logic circuit 22 as described above for receiving reel symbol signals from the circuit 22 and comparing symbols on each of the reels 12', 12'', and 12''', as a function of the position of the reel 12', 12'', and 12''', and determining if a predetermined match exists between these symbols.

A pay logic circuit 30 is connected to the comparator circuit 28 for receiving signals from circuit 28 and effecting a pay-out when predetermined matches exist among the symbols provided on the periphery of reels 12', 12'', 12'''. This circuit 30 includes a pay counter 32 connected to comparator circuit 28 for processing data received from circuit 28. Pay counter 32 is also connected to a "coin-out" sensor, such as a switch of a conventional coin hopper 34 of gaming device 10 by means of a "coin-out" relay 36, for determining, in conjunction with circuit 28, the presence of a win and completion of a pay-out for such a win.

A line 38 connects relay 36 to a pay controller 40, while a line 42 places controller 40 in communication with pay counter 32. A hopper run line 44 connects connects controller 40 with a hopper relay 46, which relay 46 is in turn connected to coin hopper 34 which selectively actuates hopper 34 and causes coins to be paid out therefrom.

A line 48 extends from controller 40 so as to provide an actuation signal to lamps (not shown) of device 10 which indicate certain functions, such as: "winner paid"; "pay in progress"; and "notify attendant".

The control system illustrated in FIG. 1 further includes a timing logic circuit 50 connected to pay logic circuit 30 and to the computing logic circuit 22 for coordinating functions of the entire control system.

Circuit 50 includes a clock 52 arranged for generating a pseudo-random pulse train for the indexing of reels 12', 12'', and 12'''. Lines 54, designated the reel #1, clock pulses, and read reel lines, connects clocks 52 to a sequencer 56. This sequencer 56 is also connected to the computing circuit 22 and the pay logic circuit 30 for correlating all functions of the control system, and therefore the associated gaming device 10. Clock 52 supplies clocking pulses to sequencer 56 over line 54.

Sequencer 56 in turn sends a clock reset pulse to clock 52 over a line 58, while clock 52 is connected to pay controller 40 by means of a line 60.

A "coin-in" relay 62 connects a "coin-in" switch 64 to sequencer 56 by means of a line 66 designated as a "credit" line. The purpose of switch 64 and line 66 will become clear below when sequencer 56 is described in detail.

A "sequence hold" line 68 connects pay controller 40 to sequencer 56, for a purpose also to be described below, while a "pay reset" line 70 connects sequencer 56 to pay counter 32 for the purpose of resetting counter 32 between sequences.

Sequencer 56 is also connected to the index circuit formed by position decode 24', 24'', 24''' as by the "not data save" and Seq. 4 line 72, 74 and the "not strobe" line 76. The purpose of these lines will become clear below during the discussion of FIG. 3A of the drawings.

A line 78 connects sequencer 56 to a line sheet circuit 80 which in turn is connected to the index circuit formed by position decodes 24', 24'', 24''' and to the pay controller 40 as by the illustrated lines 82 and 84, respectively. Line 84 is designated the "selected sequence" line. The purpose of circuit 80 is to permit selection of pay lines among the 5 possible lines shown for determination of wins. "Not Strobe" line 76 enables circuit 80 to control the decodes, while a switch 86 permits gaming device 10 to be used with either a single (center) line (Mult), with multiple odds; or multiple line win format.

Further flexibility is built into gaming device 10 by provision of a multiple position switch 88 which permits, in a simple manner, the maximum number of coins which can be used in a single play of gaming device 10 to be adjusted up to a maximum of, for example, 5 coins.

Sequencer 56 further has a line 90 emanating therefrom so as to provide control pulses to the various lamps associated with gaming device 10, although not shown herein, and a line 92 which likewise sends control pulses to the various solenoids employed with the mechanical section of gaming device 10. Since this application is only concerned with electronic control system of the gaming device 10, and since the mechanical portion of the gaming device are described elsewhere, these lamps and solenoids have not been shown or described herein.

FIG. 1 also indicates certain switches associated with sequencer 56, with switch 94 being designated a "release" switch, switch 96 being desginated a "pull" switch, switch 98 being a "clock" switch, and switch 100 being designated an "un-lock" switch. The purposes of these switches will be set forth below, particularly with regard to the discussion of FIG. 11.

When switch 86 is in the illustrated "Mult" position circuit 80 selects the center pay line 1 (FIG. 3E) for determination of wins.

Solenoid drivers 102 are connected to outputs of clock 52 in order to send actuating pulses along a lines 104 and to each of the reels 12', 12'', 12''' by branch lines 106', 106'', and 106''', respectively, in order to actuate the reel brake mechanisms, not shown or described herein, to stop the reels as desired. As mentioned above, the brake mechanisms for the reels 12', 12'' and 12''' do not form part of the invention described herein, and are set forth elsewhere. Further, the particular brake mechanism employed is not critical to the use of the control system according to the present invention.

Figure 2A:
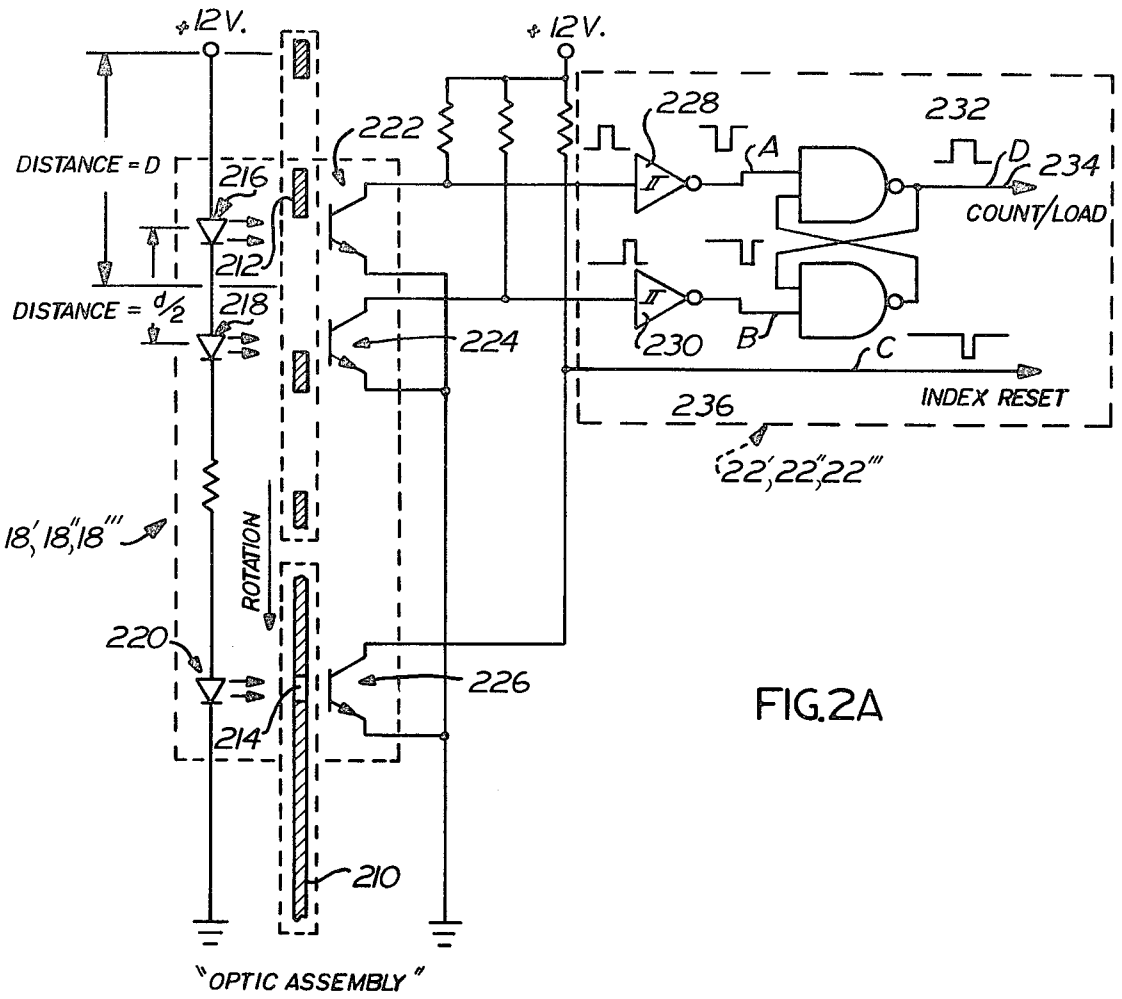
FIG. 2A is a schematic diagram, partly broken away and in section, showing the sensing unit, and specifically the optical assembly thereof according to the present invention and associated with the reel of a plural rotatable reel chance device with which the present invention is intended to be used.

Referring now more particularly to FIG. 2A of the drawings, each of the reels 12', 12'', 12''', has associated therewith an index disc 210 mounted for rotation with the associated one of the reels and provided with a periphery having therein a plurality of teeth or interrupters 212. Adjacent the periphery of the disc 210 is also provided an interrupter hole 214. These reel discs 210 are equal in number to the number of optical assemblies 18', 18'', 18''', and form part of the respective units. Also included in each of the assemblies 18', 18'', and 18''', as illustrated, are an associated pair of light emitting diodes (LED) 216 and 218 as well as a third such diode designated 220. Associated with these diodes 216, 218, and 220 are infrared phototransistors 222, 224, and 226. Each of these diode/photransistor pairs as described above is associated with a specific function. More specifically, diode 216 and phototransistor 222 cooperate to provide a pulse each time one of the teeth or interrupters 212 provided in the periphery of disc 210 blocks the line of sight between the two elements. Similarly, diode 218 and phototransistor 224 cooperate to transmit a count pulse as a function of the passage of the same teeth or interrupters 212. In combination, these load and count pulses are sent through separate Schmitt inverters 228 and 230 and into a flip-flop 232. The latter is preferably a S-R latch flip-flop as illustrated. As can be appreciated, the load pulse sets the flip-flop 232 so as to be triggered by a count pulse with the output being a function of the two pulses as shown. Specifically the output from flip-flop 232 is along a line 234, while the other output from assembly 18', 18'', 18''' is in the form of an index reset signal generated by the third diode phototransistor pair, those designated 220 and 226 respectively. The interrupter hole 214 permits communication between diode 220 and phototransistor 226 so as to send a pulse along index reset line 236, also as illustrated in FIG. 2A.

The teeth or interrupters 212 are spaced from one another, at the tips thereof, a distance designated d, with the diodes 216 and 218 being spaced a distance $^{d}/2$ so as to permit the assemblies 18', 18'', 18''' to be positioned relative to the disk 210 within a wide range of limits without affecting the accuracy of the readings. Thus, precise positioning of the assemblies 18', 18'', 18''' relative to the reels 12', 12'', 12''' is not critical. Further, no more than one of the diodes, or other sensing devices, will be blocked, or interrupted, at any time.

FIG. 2B sets forth a timing diagram for the operation of the circuit illustrated in FIG. 2A. Most significantly, the timing plots designated A, B, C and D illustrate the wave forms at the same point designated in FIG. 2A. The Count Reset pulse can be seen as arranged near the end of the "N" Count Increment in order to place counter provided in the computing circuit 22 to zero before the Count/Load signal (designated D) drops from a high to a low and assure that the aforementioned counter will go from "N" to "1" when the pulse does go low. The plots in the lower portion of FIG. 2B show the allowable regions for "reel stop" (indexed) situations. The "a" designates a safety zone in which a reel 12', 12'', 12''' shall not remain at rest to allow for mechanical variations and data ambiguities. The letter "b" designates an area in which reel bounce, jitter and rest position will not degrade accuracy of the position data. The ratio b/a is a function of pulse widths at A, B, and C, and of course, of mechanical precision.

Assemblies 18', 18'', and 18''' are connected to a suitable source of 12 volts DC, which power source may be a suitable regulated power supply (not shown).

Figures 3A, 3B:
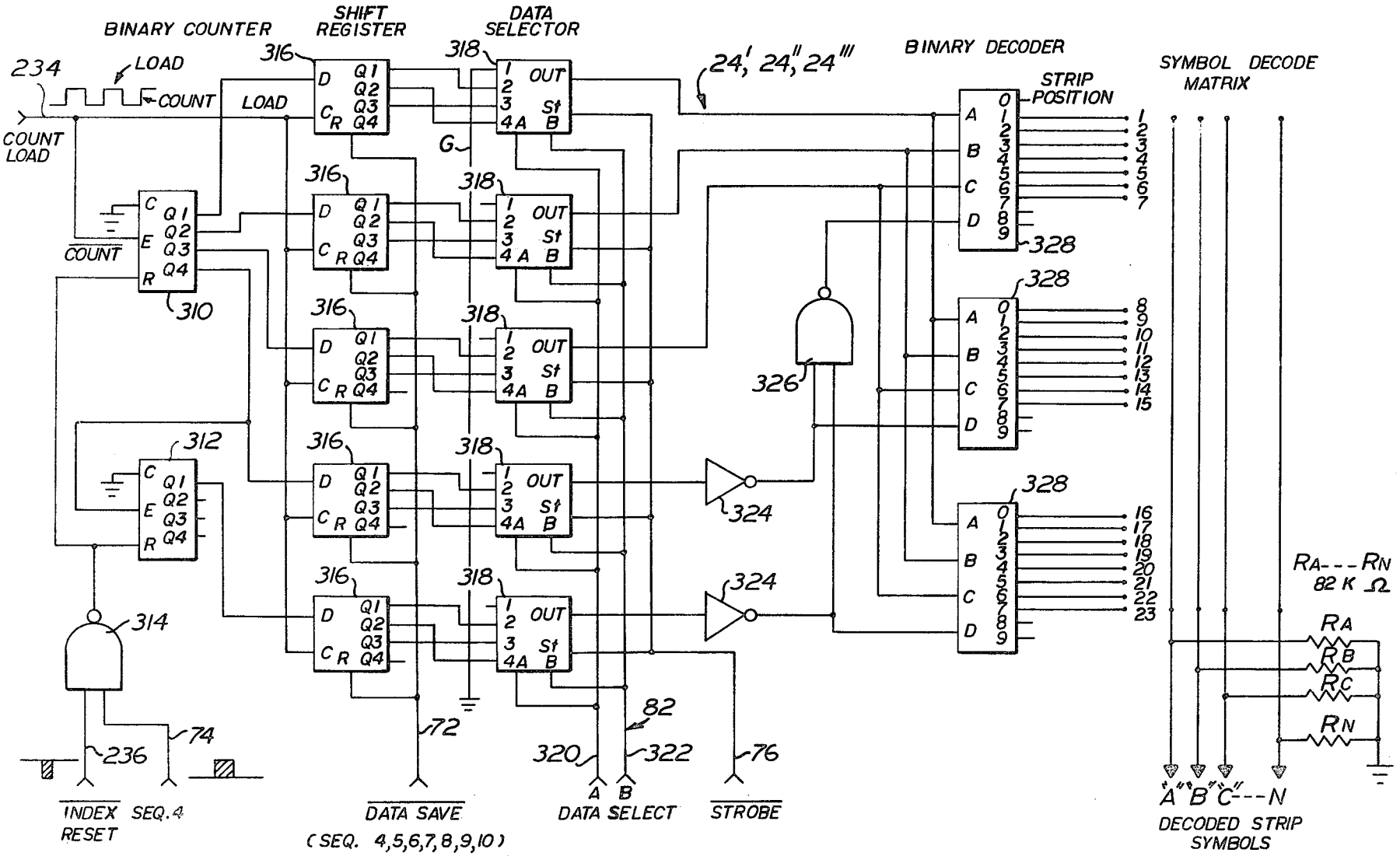
FIG. 3A is a logic diagram showing a computing circuit according to the present invention.
FIG. 3B is a schematic diagram showing a sample symbol decode matrix associated with the output of the logic circuit shown in FIG. 3A.

FIG. 3A shows one of the position decodes 24', 24'', 24''' which form the indexing portion of computing logic circuit 22. Each of these decodes 24', 24'', and 24''' has an input from line 234 of the associated assemblies 18', 18'', and 18'''. A counter 310 is connected to line 234 to receive count pulses therefrom, with one of the four parallel outputs of counter 310 forming input to a second, serially connected counter 312. Additional input into the decode is in the form of the lines 236, $\overline{\text{index reset}}$ of the associated assembly 18', 18'', 18''', and the lines 72, 74 illustrated in FIG. 1 and designated $\overline{\text{data save}}$ and "Seq. 4" in that figure. These two lines 236 and 74 form the input to a Schmitt NAND gate 314 the output of which is connected to the reset input of the counters 310 and 312 to reset the counters once per revolution and to disable the counters when not in Seq. 4.

The outputs of the counters 310 and 312, there being five outputs in all feed binary reel position data into five shift registers 316. The line 234, specifically the "load" portion thereof, forms the clock signal for shift registers 316, while the output from the counters 310 and 312 forms a data input. $\overline{\text{Data save}}$ line 72 is connected to each of the reset inputs of the registers 316 for controlling memory storage of these elements with current and 3 prior reel positions being stored, thus maintaining data on four adjacent pay lines per reel at any given time although only three lines are used in the illustrated embodiment.

The data select line 82, which is in effect two parallel wires 320 and 322, as well as the $\overline{\text{strobe}}$ line 76 form inputs into the data selectors 318 for allowing access to the data in the selector on the desired pay-line. Strobe line 76 prevents data from being passed from selectors 318 during sequence transitions. The output of the lower two illustrated data selectors 318 is fed through inverters 324 to the inputs of a NAND gate 326. A ground line G should be connected to unused inputs of selectors 318 for protecting same. Inputs A, B, and C of binary decoder 328 select one of eight outputs for each of the decoders 328. Gates 324 and 326 determine which one of the three decoders 328 shall be enabled. The outputs utilized are 0 through 7, therefore a high on input "D" of any given decoder 328, input "D" representing bit 4 (or binary 8), inhibits outputs 0 through 7 for that decoder. Only that decoder which has a low on input "D" can give an output on 0 through 7. Output "0" is not used on the topmost decoder 328, inasmuch as "0" in the decoder 328 represents the position between stops 22 and 1. It will be appreciated that more or less decoders 328 can be used, so as to provide a different number of stop stations, such as 31.

The parallel output of the binary decoders 328 represent each tooth or interrupter 212 formed in the periphery of index disk 210. These positions may represent symbols, such as Cherries, Oranges, Plums and the like, and each of these symbols may appear at more than one position of each reel 12', 12'', and 12'''. FIG. 3B shows schematically a symbol decode matrix for converting these symbols into common lines.

Figures 3C, 3D, 3E, 3F:
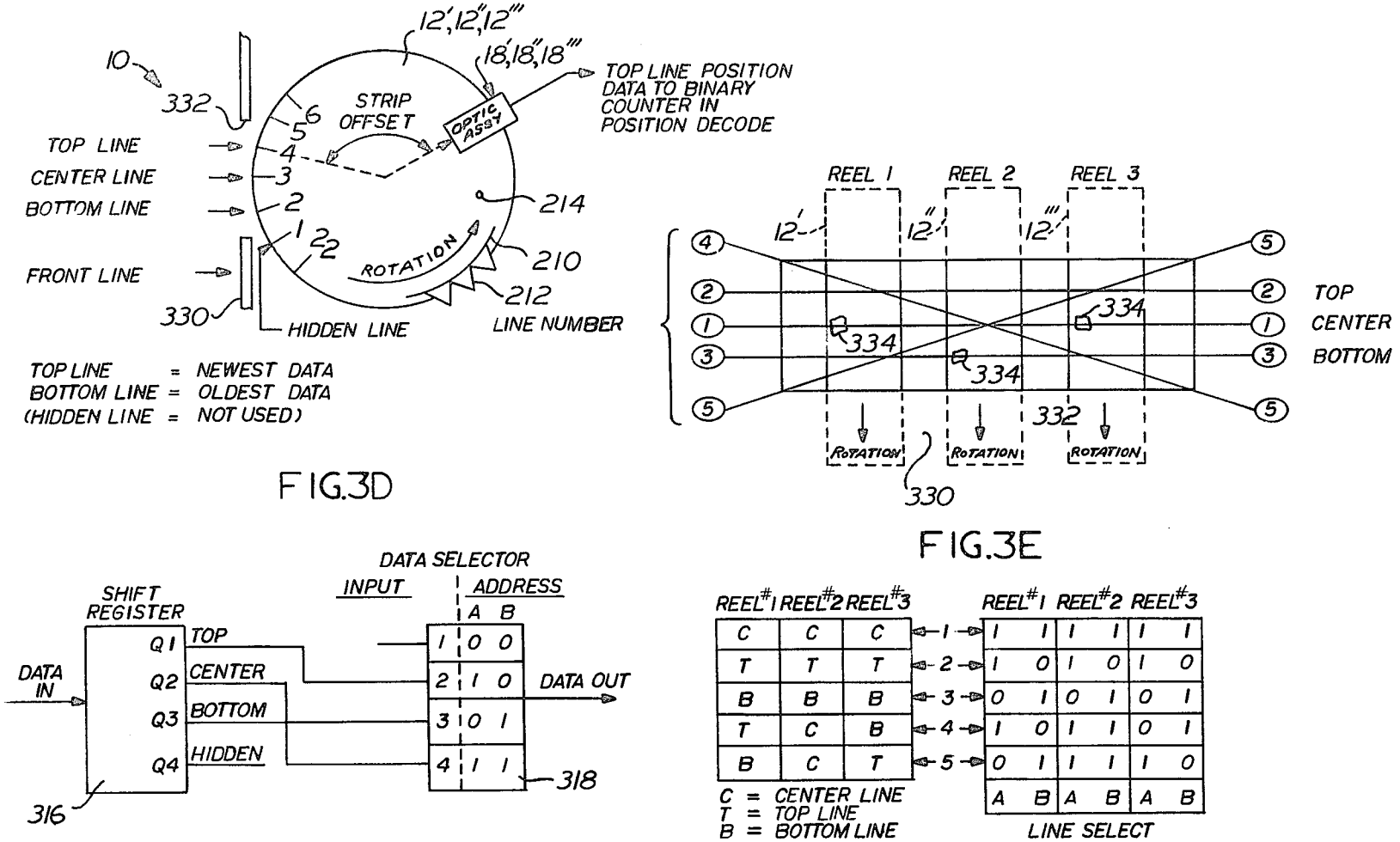
FIG. 3C is a logic diagram showing in greater detail the shift register/data selector arrangement of the computing circuit seen in FIG. 3A.
FIG. 3D is a schematic diagram showing in side elevation the reel and optic assembly arrangement seen in FIG. 2A.
FIG. 3E is a schematic diagram showing in front elevation a five pay line configuration usable with a gaming device according to the present invention.
FIG. 3F is a chart setting forth a truth table for the pay lines shown in FIG. 3E.

FIG. 3C sets forth a detail of one shift register 316 and data selector 318 combination. As can be seen, the top three output of register 316 go to the last three inputs of the associated data selector 318 because the address for input 1 of selector 318 is two zeros. The truth table shown for inputs 2, 3, and 4 in data selector 318 relates to three horizontal pay lines of a gaming device 10, which lines will be discussed in conjunction with FIGS. 3D, 3E, and 3F.

FIGS. 3D and 3E show a front cover plate 330 arranged in front of reels 12', 12'', and 12''', with a window or opening 332 being illustrated as provided in plate 330 for defining a display area of a device 10. It is noted that assemblies 18', 18'', and 18''' are behind and angularly offset from the display area as illustrated. The center horizontal pay line is designated 1, the top line 2, and the bottom line 3, while the two diagonal pay lines are designated 4 and 5. Reels 12', 12'', and 12''' are indexed so that the symbols 334 therein will register with pay lines 1, 2, and 3 when the reels 12', 12'', and 12''' are stationary.

FIG. 3F is a truth table on the right thereof which sets forth the logic for the five pay lines as charted to the left of FIG. 3F. As the bottom of the truth table are the letters "A" and "B" which correspond with the same letters at the top of the truth table in FIG. 3C, and by which can be seen the manner in which the data selector 318 can determine which pay line or lines are in play. The five registers 316, and five data selectors 318, form a 5-bit binary code which is converted by decoders 328.

Figure 4B:
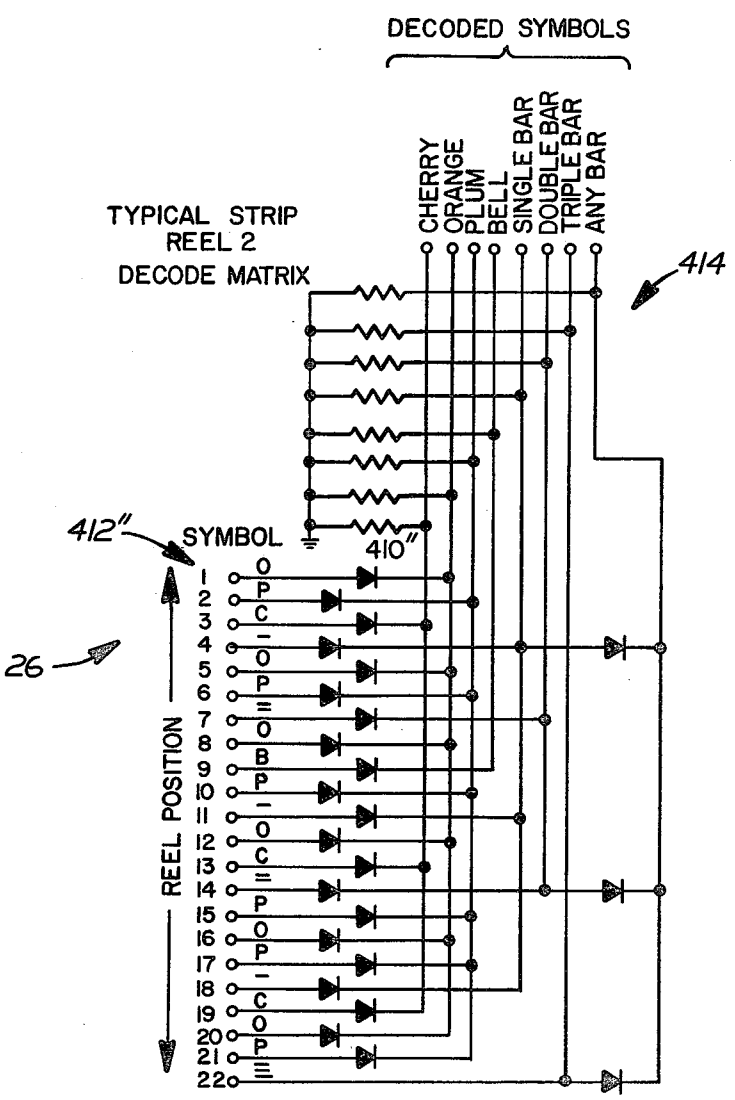
Figure 4A:
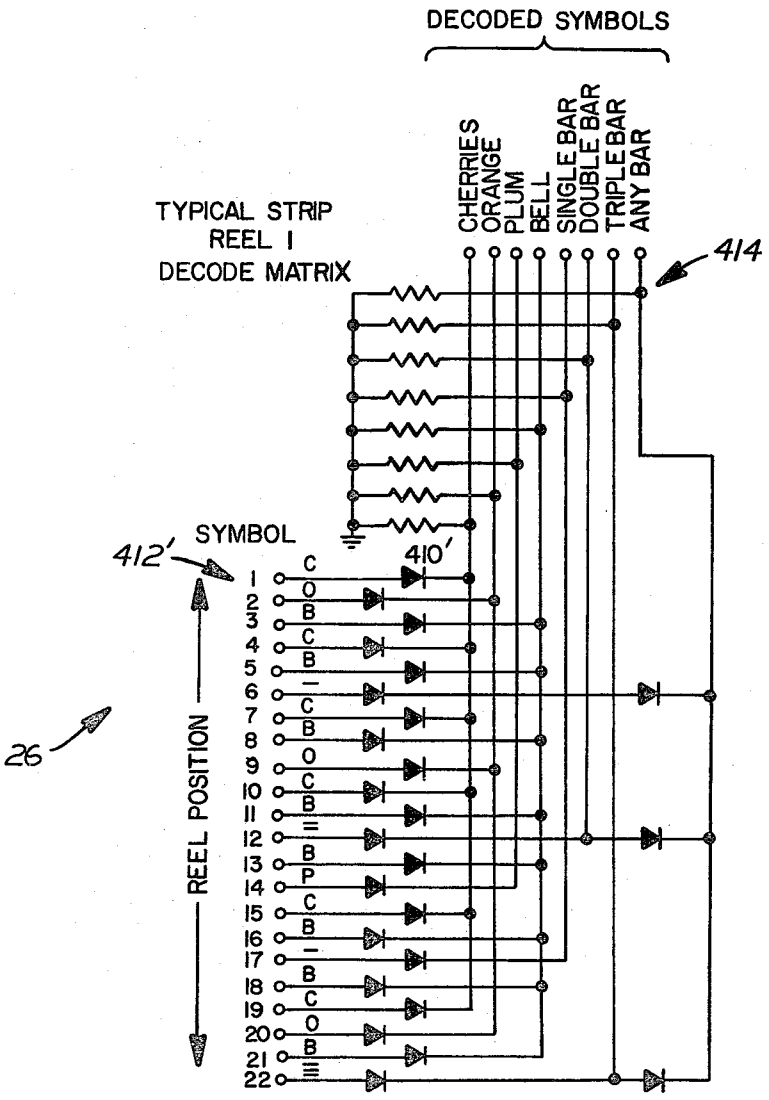

Specific symbol decode matrixes are illustrated in FIGS. 4A and 4B and 5 of the drawings. More specifically, FIG. 4A and 4B shows a matrix for reels 12' and 12'' and FIG. 5 in accordance with the preferred embodiment illustrates a possible matrix for reel 12''', which often does not have symbols representing cherries. In each matrix, or strip decode, 26', 26'' and 26''', a diode matrix 410', 410'' and 510 routes signals received from lines 412', 412'' and 512, those being the lines formed by the output of these decoders 328 of the position decodes 24', 24'' and 24''' to a plurality of lines 412', 412'', and 512, each of which represents only a single one or a combination of related ones of the symbols provided on the reel 12', 12'', and 12'''. The lines designated 516 each with a diode provided therein, tie the Orange, Plum and Bell lines of the output lines 514 into the single, double, and triple bar lines of the (for example, 22) reel position stations, as desired in a particular machine to permit mixed fruit and bar pays.

FIG. 6 sets forth the comparator circuit or win decode 28. The explanation of the symbols and subscripts set forth as part of FIG. 6 will explain the various inputs to the gates of this circuit. If input $C_1$ is high to AND gate 638, a "Pay 2" output will be produced, provided the input $C_2$ is low. $C_2$ high cancels "Pay 2" through inversion in invertor 610. If $C_1$ and $C_2$ are both high, a "Pay 5" will be produced at the output from AND gate 640, provided input $C_3$ is low. $C_3$ being high will cancel "Pay 5" through inversion in inverter 614. Inputs $C_1$, $C_2$, and $C_3$ being high will produce a "Pay 10" output from AND gate 642 and cancel outputs from gates 638 and 640. In this manner, only the highest of the three wins discussed above can produce an output.

In the embodiment illustrated (FIG. 5) the inverter 614 actually has no function, since there is not an input $C_3$, as explained above.

The circuits for Oranges, Plums, and Bells are very straightforward, as the three inputs, one for each of the reels, cooperate to gate a respective AND gate 620, 622, and 624 to effect a pay out. The circuit for the bars, however, becomes somewhat more complicated, in order to eliminate double pays. As can be seen, the any bar lines are connected and gate 626 whose output forms one of the inputs to a further AND gate 628. The output of this latter gate is the Any Bar pay. The other input to gate 628 is a NOR gate 630, whose inputs are respectively the outputs from the AND gates 632, 634 and 636 which represent the single, double, and triple bars, respectively. Thus, even if a win in any of the respective common bar circuits is effected, there will not be a win in the any bar circuit due to a negative pulse from gate 630 to one of the inputs of gate 628, and the "Pay 20" will be cancelled.

As can be seen from FIG. 6, the output of the several AND gates are designated by the reference numberals 638, 640, 642, 644, 646, 648, 650, 652, 654, and 656 to represent pays of 2, 5, 10, 10, 14, 18, 20, 50, 100, and 200, or jackpot, respectively.

Figure 7:
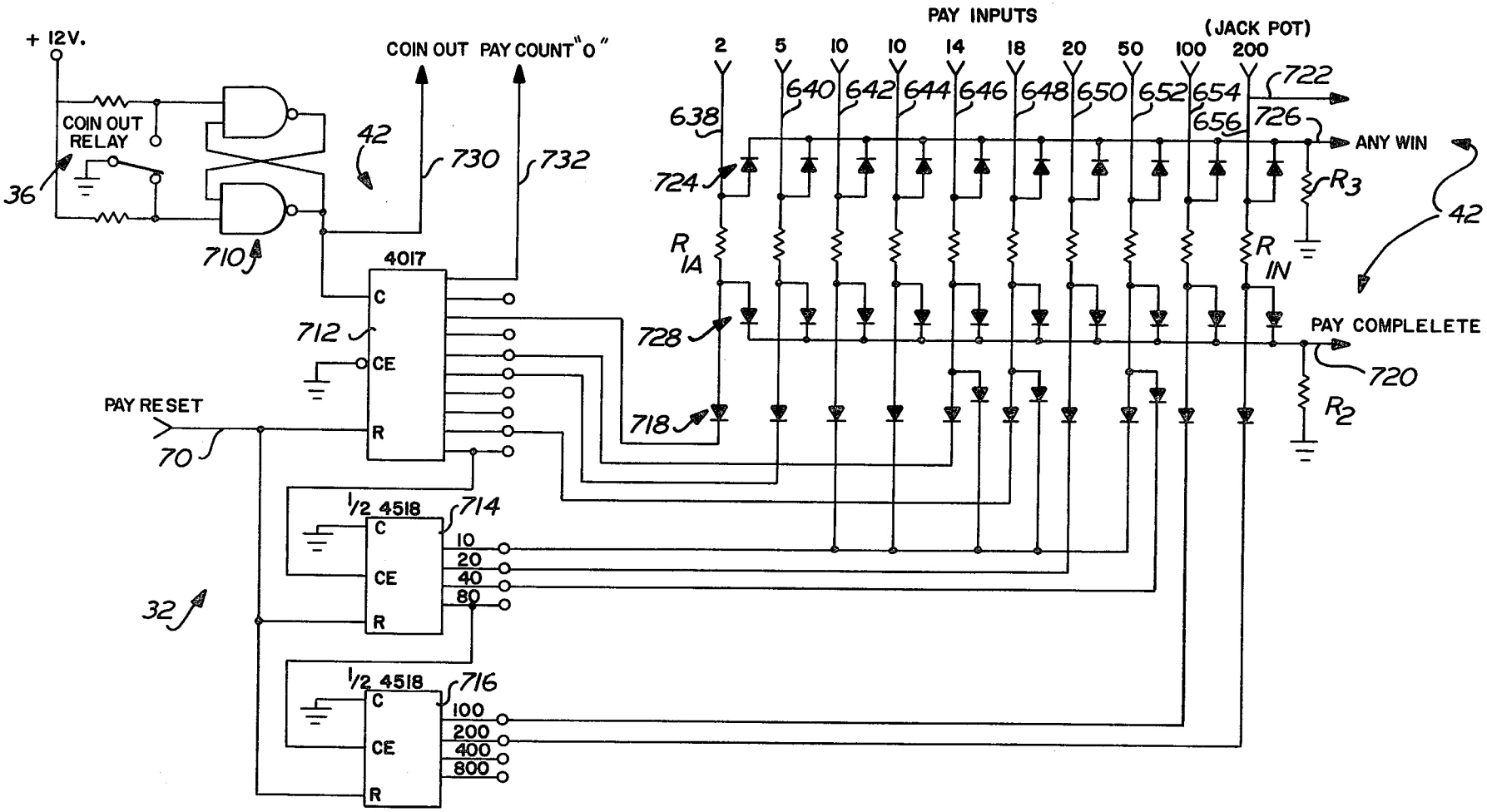
FIG. 7 is a logic diagram showing a pay counter circuit according to present invention.

The details of pay counter circuit 32 are set forth in FIG. 7 of the drawings. Specifically, circuit 32 includes a flip-flop (S-R latch) 710 connected to the aformentioned source, or other suitable source of 12 volt direct current, and having connected across same the "coin out" relay 36 such that relay 36 actuates flip-flop 710. The output of a decade counter 712 represents coins or token paid out in units (0 through 9), while the BCD counters 714 and 716 represent coins or token paid out in tens and hundreds, respectively. When the outputs of counters 712, 714, and 716 equal the number selected by a diode matrix 718, the "pay complete" line 720 is pulled high by resistances $R_1$, with resistances $R_1$ exercising control over the influence of resistance $R_2$ since $R_2$ is a much higher resistance. For example, $R_2$ should be at least 15 times higher than $R_1$. The value of resistance $R_3$ is not critical. The resistance $R_2$ is used as a pulldown resistor for line 720 when coins paid out are less than required by the pay inputs. As can be seen in the upper right hand corner of FIG. 7, an output is taken directly off of the jackpot line 656 by means of line 722 so as to permit a direct pay of a jackpot either from the machine or by an attendant. The remaining ones of the pay lines go through a plurality of diodes 724 to "any win" line 726 to effect a pay, and also goes through a plurality of diodes 728 to the "pay complete" line 720. The signals from the aformentioned pay lines 638, through 656, run through the diode matrix 718 to parallel terminals of counters 712, 714 and 716. The clock terminal of counter 712 is driven by the flip-flop 710. Also extending from the clock terminal of counter 712 is a Not Coin-Out line 730. The ("0") designated terminal of counter 712 has extending therefrom a line 732 designated the pay count "0" line. The purpose of lines 730 and 732 will become apparent below with the discussion of other circuits of the control system according to the invention.

Figure 8:
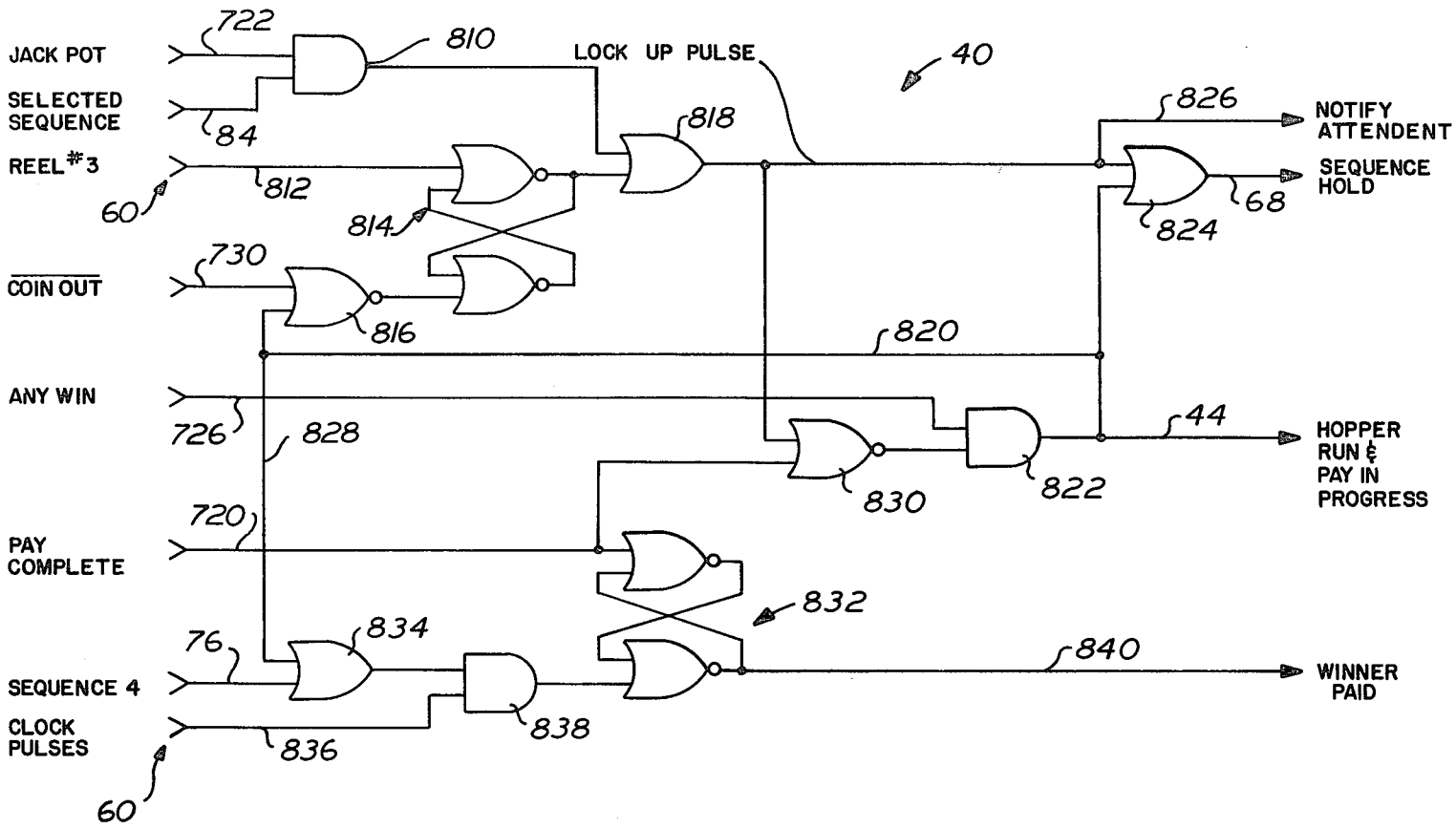
FIG. 8 is a logic diagram showing a pay control unit according to present invention.

FIG. 8 of the drawing shows the logic circuit for pay controller 40. In this circuit, the jackpot line 722 and selected sequence line 84 form inputs to an AND gate 810, while the reel 3 line 812 forms an input to a flip-flop (R-S latch) 814. The other input to flip-flop 814 is formed by the output of a NOR gate 816 which has as one of its input the not coin out line 730. The outputs of AND gate 810 and flip-flop 814 form inputs to an OR gate 818 which together with the output from an AND gate 822 form the input to an OR gate 824. The output of gate 822 is connected to relay 46 by line 44 to effect pay cycles. The output of OR gate 824 is the sequence hold line 68, while one of the inputs, specifically that from the output of OR gate 818, of OR gate 824 is used as a connection for a "notify attendant" line 826. Line 820 also forms one of the inputs of the NOR gate 816, thus connecting that input of 816 to the output of gate 822. One of the inputs of AND gate 822 is to the "any win" line 726, while the other of the inputs to gate 822 is the output of a NOR gate 830. Gate 830 has one of its inputs as the output of OR gate 818, with the other input to gate 830 being a signal from the pay complete line 720. Pay complete line 720 also forms one of the inputs to a flip-flop (SR-S latch) 832, the output of which flip-flop 832 forms a "winner paid" line 840. The other input to flip-flop 832 is formed by a gating circuit including an OR gate 834, one of the inputs to which is also the output of AND gate 822 via line 820 and line 828, while the other input to gate 834 is seq. 4 line 76. The output of OR gate 834 together with the clock pulses line 836 of the multiwire line 60 form the inputs of an AND gate 838, the output of which gate 838 forms the other of the inputs to flip-flop 832.

Any win line 726 activates hopper run/pay in progress line 44 via gate 822 until the pay complete line 720, inverted by gate 830 disables gate 822. The output of gate 822 also activates sequence hold line 68 through gate 824. Pay complete line 720 also sets flip-flop 832, turning on winner paid lamp line 840. Line 840 is initially tuned off by seq. 4 line 76 during reel spin. Additional pays during a single play of the machine also turn off flip-flop 832 via lines 820 and 828. Clock pulse line 60 and 838 delay turn off to prevent glitches on line 820 from prematurely turning off winner paid light.

Line 722 and 84 activate sequence hold line 68 via gate 810, 818, and 824, and energize the notify attendant lamp line 826 at the same time. Gate 822 is inhibited via inversion through gate 830 preventing hopper run. This situation represents a hand paid jackpot and prevents the machine being played until reset by an attendant (not shown) by means of unlock switch 100.

An additional locked-up condition is provided in the following manner: "$\overline{\text{Coin-Out}}$" line 730, which goes low as a coin exits the hopper of the machine, acts in conjunction with line 820, which is low, to set flip-flop 814 by means of gate 816. This condition represents the output of a coin in the absence of a pay command. In this situation, an attendant must reset the machine to seq. 1 to allow the machine to be played and the locked up condition will reset when the 3rd reel (12''') indexes and pulses line 812.

Figure 9:
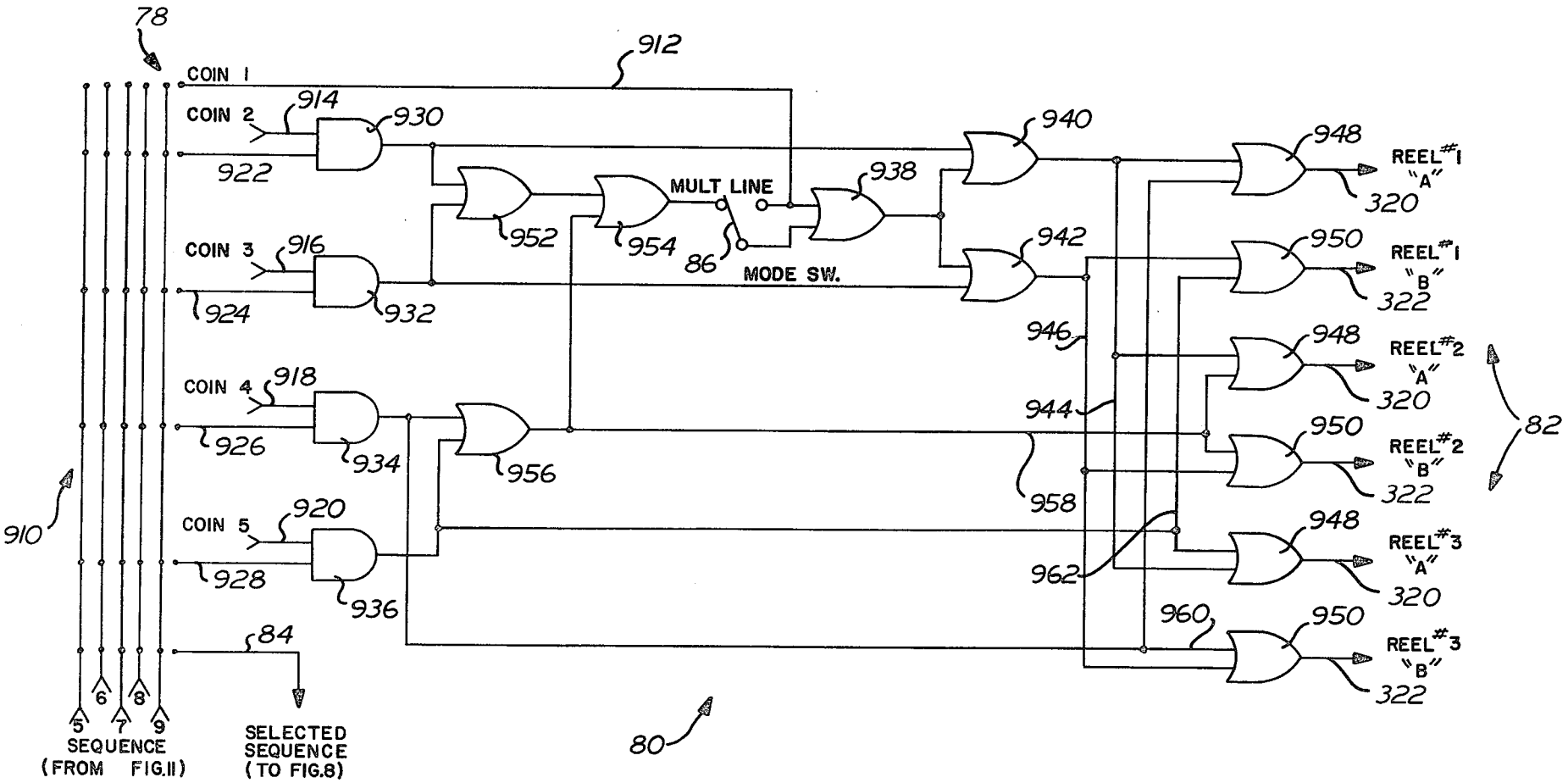
FIG. 9 is a logic diagram showing a line select control circuit according to present invention.

Referring now more particularly to FIG. 9 of the drawings, sequence lines designated 910 (which form line 78 of FIG. 1) are illustrated at the left hand side of the circuit depicting the line select circuit 80. These lines 910, which specifically are the sequences 5, 6, 7, 8, and 9 lines, are connectible in varying ways to a plurality of inputs designated 912, 922, 924, 926, and 928, and representing 1 through 5 coins played. More specifically, lines 922, 924, 926, and 928 form sequence input lines to respective AND gates 930, 932, 934, and 936, with coin lines 914, 916, 918, and 920 forming the other gate input. These sequence input lines 922, 924, 926, and 928 are not shown in FIG. 9 as connected to any of the sequence 5 through 9 lines because the manner of attachment may vary as a function of the particular machine operation intended. For example, for a three reel, five pay line, multiple mode machine (FIGS. 3D and 3E) coin line 912 (for 1 coin played) and sequence input lines 922, 924, 926, and 928 could be connected to sequence lines 5, 6, 7, 8, and 9, respectfully. Selected sequence line 84, whose function is to lockup the pay circuit of the machine for handpay jackpots, is always connected to the sequence line 910 to which is attached the sequence input line 922, 924, 926, and 928, or a coin line 912 for a single coin machine, representing the highest number of coins playable in the machine. In the present example, line 84 would be connected to the sequence 9 line.

As will be appreciated from the above discussion, only one sequence line 910 need be connected to the line select circuit 80. Any number of coin plays from 1 through 5 (or more if the number of sequence lines 910 available is increased) can be programmed into a machine by appropriate connection of the sequence input lines 922, 924, 926, and 928. Coin line 912, however, will always be connected to a sequence line 910.

Further, if it is desired to construct a machine that only functions in a multiple odds pay mode, for example, the sequence input line for the highest number of coins playable (line 928 for a five coin play machine, line 924 for a three coin play machine, and so forth) is preferably connected to the lowest sequence line 910 available (sequence line 5 in the illustrated embodiment) together with selected sequence line 84 so as to cause machine lock-up for handpay jackpots before the first machine pay out can take place. Otherwise, the machine would not lock-up and automatic pays would be made until the last coin played was reached.

Coin 1 line 912 is connected directly to an input of an OR gate 938 so that a single coin will gate further OR gates 940 and 942 and send a "1" signal along data select A and B wire 320 and 322 (which form line 82 of FIG. 1) to data selector 318 for decode circuits 26', 26'', and 26''' of all three reels 12', 12'', and 12''' and select data for the center line 1 only (see FIGS. 3D, 3E, and 3F). Lines 944 and 946 connect the output of gates 940 and 942 to the input of OR gates 948 and 950, respectively, the "A" and "B" sides of each data selects 26', 26'', and 26'''.

The output of gates 930, 932, 934 and 936 also are connected to gate 938 when mode switch 86 is in the "Mult" position, as illustrated, so that center line data will be sequentially processed, and, sequential pays made for a win, for each coin played. For this purpose, the output of gates 930 and 932 pass through a pair of OR gates 952 and 954 to switch 86, while the output of gates 934 and 936 pass through an OR gate 956 to gate 954 and switch 86 to gate 938.

When mode switch 86 is on the "Line" position (not shown) the gates 952 and 954 and 956 will be disconnected from gate 938. In this mode, each gate 930, 932, 934, and 936 are connected directly to selector gates 948 and 950 for sequential line data selection. More specifically, gates 930 and 932 are connected directly to gates 940 and 942, respectively, for gating "A" data only for coin 2 (top line 2, FIG. 3E) and "B" data only for coin 3 (bottom line 3, FIG. 3E). Coins 4 and 5 require mixed combination of "A" and "B" data, with gate 934 (coin 4) being connected to a line 958, via gate 956, which pulses both gates 948 and 950 for reel 12'' (data selector 26''). Further, gate 934 is connected directly to a line 960 tying together the "B" side of reel 12''' (data selector 26''') and the "A" side of reel 12' (data selector 26'). Thus, it can be seen from FIG. 3F that pay line 4 will be defined when gate 934 goes high.

The output of gate 936 (coin 5) is also connected to gate 956 and line 958 for actuating both "A" and "B" sides of reel 12''. Further gate 936 is connected directly to a line 962 typing together the "A" side of reel 12''' and the "B" side of reel 12'. Again, with reference to FIG. 3F, it can be seen that pay line 5 will be defined when gate 936 goes high.

Figure 10:
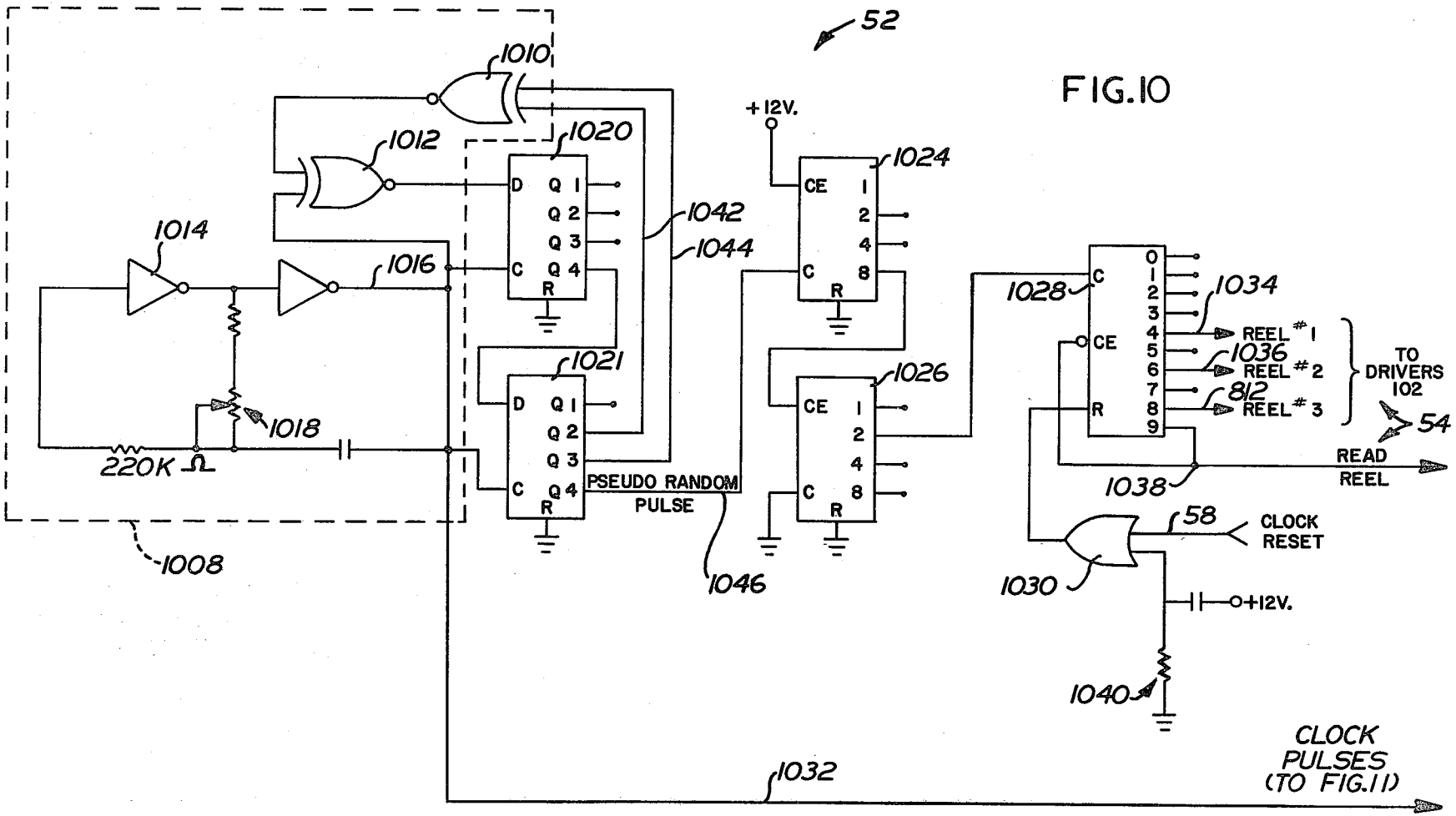
FIG. 10 is a logic diagram showing a clock circuit for use in the timing logic circuit of the system illustrated in FIG. 1.

The details of the clock 52 as illustrated in FIG. 10 reveals an oscillator circuit 1008 employing a pair of exclusive OR gates 1010, 1012, and a pair of inverters 1014 and 1016 which together with a potentiometer 1018 in a RC circuit and a pair of shift registers 1020, 1021 form a sub-circuit which generates a pseudo-random pulse train and permits adjustment of the spin time of all of the reels 12', 12'', 12''' by adjustment of the single potentiometer 1018. The single output of this sub-circuit is attached to the clock input of BCD counters 1024, and 1026 which are also connected to a source of regulated 12 volt DC current. The output of register 1026, only one of several outputs being used, is connected to the clock input of a decimal counter 1028. Another input into counter 1028 is the output of an OR gate 1030, which in turn has one input as the clock reset line 58 and the other an RC net work 1040 which resets the counter 1028 when power is applied, thus assuring counter 1028 will always start at "0". A counter "clock pulses" line 1032, which line is one of the wires of the multi-wire line 54 of FIG. 1, extends directly from the oscillator circuit. Three of the parallel outputs of counter 1028 are used as reel line #1, designated 1034, the reel #2, designated 1036, the reel #3, designated #812, and "read reels" 1038.

Oscillator circuit 1008 feeds pulses at a rate predetermined by potentiometer 1018 into shift registers 1020 and 1021. For sake of illustration, assume 20 pulses per unit time at the output of inverter 1016. These pulses are fed through seven outputs of registers 1020 and 1021, with the last two outputs, $Q_2$ and $Q_3$ of register 1021, being fed to the inputs of gate 1010 by lines 1042 and 1044. If both lines 1042 and 1044 are high or both low, a low will be fed back into register 1020. Thus, a varying pulse train will be sent from output $Q_4$ of register 1021. Since the number of such pulses sent along line 1046 to counter 1024 will be less than 20 per unit time, varying perhaps from 7 to 15, the signal along line 1046 is called a "pseudo-random" pulse train, and functions to vary the relative spin times of reels 12', 12'', and 12'''. It will be appreciated that the clock pulses on line 1032 will vary similarly to those fed into registers 1020 and 1021.

Figure 11:
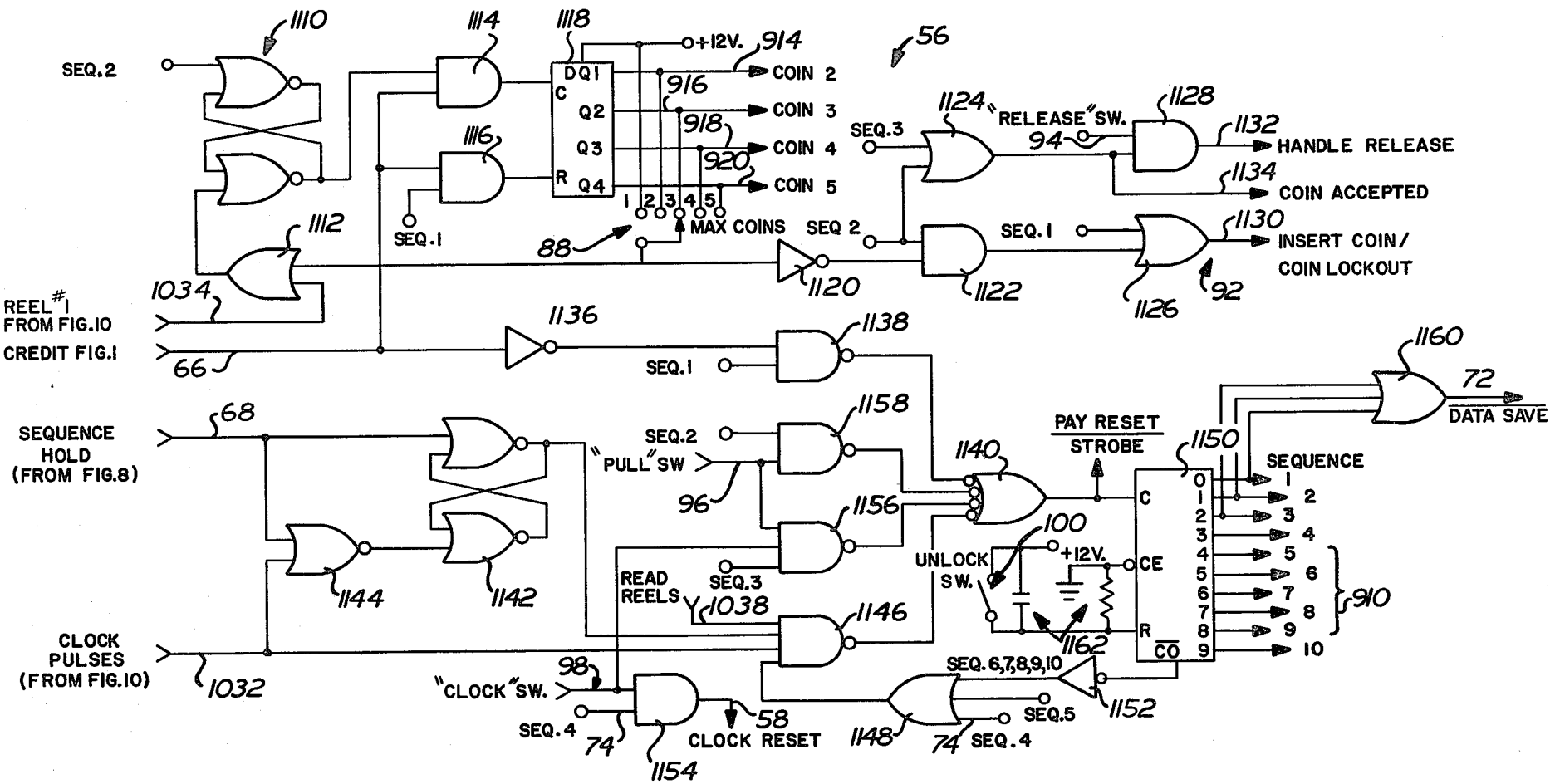
FIG. 11 is a logic diagram showing a control or sequence circuit which cooperates with the clock set forth in FIG. 10 to form the timing logic circuit of the electronic control system according to present invention.

FIG. 11 sets forth the details of the circuit forming sequencer 56. One input into sequencer 56 is the seq. 2 line also produced by the circuit. More specifically, seq. 2 is an input to a flip-flop (RS latch) 1110 which acts as a latch to prevent coins from being accepted once the reel 12' has stopped, the other input into which is from reel #1 line 1034 through an OR gate 1112. The output of flip-flop 1110 forms one input to AND gate 1114, while the other input into gate 1114 is from credit line 66, which credit line 66 also forms one input into a further AND gate 1116. The second input into gate 1116 is seq. 1. The output of the gates 1114 and 1116 form the clock and reset input of a shift register 1118, which shift register 1118's data input is connected to a source of 12 volt DC power and the parallel outputs of which shift register 1118 form the coin lines 914, 916, and 918, and 920. Inserted into each of these coin lines and into the power line are the poles of "maximum coins" switch 88. The common pole of switch 88 is also one of the inputs to OR gate 1112 for causing gate 1112 to emit a pulse to flip-flop 1110 when the maximum number of coins output setting is reached. Such actuation of flip-flop 1110 will prevent the higher coin outputs from being pulsed.

Switch 88 is also connected by means of an inverter 1120 to one of the inputs of AND gate 1122. The other input to which is seq. 2. The latter together with seq. 3 are also the inputs to an OR gate 1124, with the outputs of gates 1122 and 1124 being connected to one of the inputs of an OR gate 1126 and AND gate 1128 respectively. Seq. 1 forms a second input to gate 1126, while "release" switch 94 is a second input to gate 1128, with the outputs of gates 1126 and 1128 being connected to the insert coin/coin lock out and handle release solenoids (not shown), respectively, by lines 1130 and 1132. A line 1134 extends from the output of gate 1124 to a coin accepted lamp (not shown). As mentioned above, these solenoids form part of the gaming device 10 construction, which construction does not form part of the invention described herein.

An inverter 1136 connects credit line 66 to an input of a NAND gate 1138, the output of which gate 1138 is connected one of the negative inputs of gate 1140. Gate 1140 will be seen from FIG. 11 to be an OR gate provided with negative inputs. Also in this part of the circuit of seg. 56 is a flip-flop (R-S latch) 1142 one of whose inputs is the sequence hold line 68. Line 68 also forms one of the inputs to a NOR gate 1144 forming the gating circuit for flip-flop 1142, with the other input to gate 1144 being the clock pulses line 1032. The output of gate 1144 forms the second input to flip-flop 1142. In this manner, flip-flop 1142 is pulsed by clock pulses and by a pulse sent over the sequence hold line 68, the latter causing the sequence to be held when the machine locks-up or has a pay in progress. The output of flip-flop 1142 forms one of four inputs into a NAND gate 1146, the output of which also forms an input to gate 1140. Two of the other inputs to gate 1146 are the read reels line 1038 and the clock pulses line 1032, with the third input being through an OR gate 1148 receiving seq. 6, 7, 8, 9, and 10 signals from a decode counter/divider 1150 by means of an inverter 1152. The other inputs to gate 1148 are seq. 4 and seq. 5 signals.

An AND gate 1154 is provided for generating signals sent over clock reset line 58 to reset the clock 52 (FIG. 10). The inputs to gate 1154 are "clock" switch 98 and the seq. 4 line, designated 74. Line 98 also forms one of the inputs of NAND gate 1156, with the other two inputs to gate 1156 being from the "pull" switch 96 and from seq. 3. Pull switch 96 forms a first input to gate 1158, while a second input to gate 1158 is from seq. 2. The output of gates 1156 1158 are connected to inputs of gate 1140, with the output of the latter forming both the pay reset/$\overline{\text{strobe}}$ lines 70 and 76 (see FIGS. 7 and 3A) and the clock input into counter/divider 1150. The parallel outputs of counter/divider 1150 form the sequence signals 1 through 10.

The "unlock" switch 100 permits the counter/divider 1150 to be reset by the operator after a "lock-up" for a handpay jackpot.

The not data save line 72 is formed by the output of an OR gate 1160 having three inputs connected to the sequence 1, 2, and 3 lines, respectively, so that data will be dumped during those three sequences and saved during sequences 5 through 9 (sequence 10 not being used).

An RC circuit 1162 resets counter/divider 1150 to "0" when power is first applied.

OPERATION OF THE PREFERRED EMBODIMENT

Referring especially to FIGS. 1 and 11 of the drawings, it will be seen that the Optic Assemblies 18', 18'', and 18''' comprise infrared LED light sources and phototransitors. They are mounted, straddling each of the three reel disks 210. The rotating reel disks 210 interrupt light beams causing signals to be produced which relate to the instantaneous position of each of the reel assemblies 12', 12'', and 12'''. These signals are squared and shaped by Schmitt triggers and flip-flop circuits. They are applied to input position decode circuits 24'', 24'' and 24'''. The position decode circuit processes the incoming information and determines the position of the reels while the reels are rotating and retains this information after the reels are indexed. This information then proceeds to the strip decode circuit which 26', 26'', and 26''' with position information as an input, and through the use of diode matrix type memory, determines the symbol appearing at the position in question. Each reel requires its own optic assembly including wave shaping circuit, position decode, and strip decode circuit. In the three (3) reel machine, the three (3) outputs from the strip decode circuit are applied to the win decoder 28. This circuit looks for winning combinations based on individual or combinations of symbols. If a win is present, this information is then provided to the pay counter 32. The pay counter 32 then sends a command to the pay control circuit 40 which operates hopper relay 46 which turns on the hopper motor (not shown), causing coins to be paid out. As coins are paid out, they actuate a switch which actuates the coin out relay 36, which sends one (1) pulse per coin paid out to the pay counter 32. The pay counter 32 counts these pulses received from the coin out relay 36, and compares its total count to the count commanded by the Pay input from the win decode circuit 28. When these numbers are equal, the pay counter 32 sends a pay complete signal to the pay control circuit 40 which then turns off the hopper relay 36 and coin hopper hopper 34, stopping the flow of coins. When the machine is first placed into operation, various circuits are initialized. The sequencer 56 goes to sequencer 1, which is the standby or idle position. The clock 52 sends an index pulse to each of the three (3) reel index solenoids (not shown) ensuring that all three (3) reels are indexed or latched in place. After the reels are latched in place, the clock 52 assumes the standby condition. Sequence 1 in the sequencer 50 is a condition in which the "insert coin" lamp (not shown) is lit, instructing the player that a coin may be placed into the machine. The coin lock out solenoid (not shown) is energized which allows the conventional coin transporter (not shown) of device 10 to mechanically process a coin rather than reject it back to the coin tray (not shown) of device 10. Also, in sequence 1, the position decodes 24', 24'', and 24''' and the strip decodes 26', 26'' and 26''' have been reset so that they contain no information regarding the reel position. When the first coin is inserted into the machine, it is processed by the transporter mechanism, the output of which is "coin in" switch 64. This switch actuates "coin in" relay 62 which then gives a credit input (line 66) to the sequencer 56. This credit input causes the sequencer 56 to assume sequence 2. Sequence 2 results in a handle release, which is an unlocking of the handle lock mechanism (not shown). At this time the handle may be pulled if desired. Sequence 2 also lights the "coin accepted" light (not shown) indicating that at least one (1) coin has been played, sequence 2 further on resets circuit 1118 counter which keeps track of the coins played in any given game. This circuit causes coin lamps 2, 3, 4, and 5 to be extinguished if they were previously on, illuminating only coin 1 lamp. If the Max Coins switch 88 on the sequencer 56 has been set to a number greater than one (1), additional coins may be played into the machine if desired. This action causes lamps (not shown) to be lit which indicate the total number of coins played in any given game. If the maximum number of coins have been played as selected by the Maximum Coin switch 88, which is a set up switch, the sequencer 56 then extinguishes the "insert coin" lamp, and also de-energizes the "coin lock out" solenoid. Any additional coins played into the machine will be returned to the player rather than be processed into the transporter. When the player starts to pull the handle, this actuates the pull switch 96 which forces the sequencer 56 into sequence 3. Once the handle pull has been initiated, coins will not be accepted by the machine, and the player must continue the handle pull. The pull switch 96 actuates shortly after the start of the handle pull. Near the end of the handle pull, just prior to reels starting to spin, the clock switch 98 is actuated. The clock switch 98 advances the sequencer 56 to sequence 4 and at the same time resets the clock 52. As the handle is pulled to the end of the stroke, the clock switch 98 returns to its normal position, releasing a reset pulse to the clock 52. The clock 52, after random intervals, sends signals through the solenoid drivers 102 to reel reel 12', then reel 12'', and then reel 12''' index solenoids (not shown). This causes the three (3) reels 12', 12'', and 12''' to stop in sequence. Shortly after reel 12''' has stopped, the clock 52 produces a signal which allows the sequencer 56 to advance to sequence 5. Sequence 5 is the first of five (5) sequences which the machine uses to determine if a win is present, and will initiate the sequence of events which causes coins to be paid back to the player if a win is found. These five (5) sequences, sequence 5, 6, 7, 8, and 9, are active depending upon the total number of coins played. If only one (1) coin has been played, then only one (1) of these sequences would result in the possibility of a pay out. If all five (5) coins has been played into a five (5) coin machine, then all five (5) sequences could result in pay. There is no fixed relationship between the sequence number and the number of coins played. Information regarding the number of coins played is sent to the line select circuit 80. This circuit 80 has a switch 86, which is marked "Line Multiplier". The line select circuit 80 checks all lines played for a winning combination. The "not data save" ($\overline{\text{data save}}$) line 72 and the sequence 4 signal 74 from the sequence circuit 56 ensures that information is retained in the position decodes 24', 24'', and 24''' only as long as necessary. These circuits are then reset, which dumps all existing data to ensure that should the reels 12', 12'', and 12''' not spin, or for some reason new information is not presented to the position decodes 24', 24'', and 24''', the machine cannot act on previous information. The "not strobe" ($\overline{\text{Strobe}}$) line 76 from the sequencer 56 to the position decodes 24', 24'', and 24''' inhibits position decode outputs during sequence transitions. Data Select A and B line 82 from the Line Select circuit 80 to the position decodes 24', 24'', and 24''' selects top, center, or bottom line reel information. The "pay reset" line 70 from the sequencer 56 to the pay counter 32 resets the pay counter 32 during all sequence transitions. "Selected sequence" and "jackpot" inputs to the pay controller 40 puts the machine in a hand pay mode on certain jackpots. This prevents pay out of coins by the machine, and puts the machine in a locked up condition, illuminates the "notify attendant" light (not shown) and prevents further play of the machine until the attendant has reset the machine to sequence 1 through the use of unlock switch 100. A "not coin out" ($\overline{\text{Coin Out}}$) signal allows the pay controller 40 to detect over payment or hopper runaway condition. These are conditions where coins exit the hopper in the absence of a "hopper run" signal. The "pay in progress" lamp (not shown) is lit whenever pay controller 40 gives a "hopper run" signal. After pay out is completed, the "pay in progress" light goes out. The "sequence hold" line 68 inhibits sequence transitions while the pay is in progress. Clock pulses to the pay controller 40 synchronize the "winner paid" light (not shown). The sequence 4 line to the pay controller 40 turns off the "winner paid" light during the next game. Reel #3 signal to the pay controller 40 clears the "overpay monitor" (flip-flop 814) within the pay controller 40 during the next game. Signals from the clock 52 to the sequencer circuit 56 synchronize sequence transitions.

SUMMARY

As can be readily understood from the above description and from the drawings, an electronic control system according to the present invention, permits operation of a plural rotatable reel gaming device to be controlled in a reliable and precise manner without need of precise adjustment of the optical sensing equipments, and the like, on the mechanical structure of the device. Further, the handling of pay-outs can be performed in an exact and reliable manner, with the system permitting both reel spin time and the mode of winning (line or multiple line) to be easily determined by adjustment of a potentiometer and the throwing of a switch, respectively.

We claim:

1. Apparatus for controlling an amusement device including a plurality of rotatable reels provided with indicia in the form of discrete symbols, the apparatus comprising, in combination:

(A) input means associated with the reels of an amusement device for continuously detecting the position of each of the reels while the reels are rotating;

(B) computing means connected to the input means for receiving reel position signals from the input means and maintaining data on plural positions of each of the reels; and (C) comparator means connected to the computing means for receiving reel symbol signals from the computing means and comparing the symbols on each of the reels as a function of the position of the reels and determining if a predetermined match exists between the symbols of the reels; the input means including, in combination: sensing means associated with the reels for detecting the positions of the rotating reels; and pulse shaping means connected to the sensing means and to the computing means for receiving signals from the sensing means and conditioning these signals for input into the computing means; the sensing means including sensor units arranged with respect to the associated reels for being pulsed by the rotation of the reels, interrupter means associated with the reels for actuating the sensor unit means as a function of symbols provided on the reels, and revolution indicating means associated with the reels for actuating the sensor unit means with each revolution of the reels, a pair of sensor unit means being spaced apart a distance d/2 where d is the center to center spacing of adjacent interrupter means and the interrupter means are spaced such that no two sensor unit means are simultaneously actuated by the interrupter means; the sensor unit means comprising a plurality of radiation sensing units; the amusement device having a plurality of pay lines consisting of information indicating the position of the reels, and the computing means including, in combination: index circuit means connected to the input means for receiving reel position data from the input means and processing the data received to determine a plurality of pay lines; and strip decode means connected to the index circuit means and to the comparator means for receiving a signal from the index circuit means and converting data contained in the signal into a symbol outputs, decoded data being fed to the comparator means; and the index circuit means including a plurality of position decode circuits, one such decode circuit to each of the reels, each position decode circuit comprising, in combination: counter means connected to the input means for receiving therefrom a signal which is a function of at least one position of an associated one of the rotatable reels; shift register means connected to the counter means for storing current and prior reel position data; data selector means connected to the shift register means for routing data from the shift register means to the strip decode means; and binary decoder means connected to the data selector and to the strip decode means for converting binary signals received from the data selector into a reel pay line signal.

2. Apparatus as defined in claim 1 further including:

line select means connected to the index means for permitting selection of single or multiple pay lines for the determination of multiple line and multiple odds wins.

3. Apparatus as defined in claim 2 further comprising pay means including:

counter means connected to the comparator means for processing data from the comparator means, and connected to a sensor of the gaming device, for determining presence of a win and completion of pay-out for a win, and;

pay control means connected to the pay counter means for receiving a signal from the pay counter means and actuating a hopper of an associated amusement device to effect a pay.

4. Apparatus as defined in claim 3, further comprising:

timing means connected to the pay means and computing means for coordinating functions of the control circuit.

5. Apparatus as defined in claim 4, wherein the timing means includes:

clock means for generating a pseudo-random pulse train for the indexing of the reels; and sequence means connected to the clock, to the computing means, and to the pay means for coordinating all functions of the system and the associated gaming device, the clock means supplying clock pulses to the sequencing means.

6. Apparatus for controlling an amusement device including a plurality of rotatable reels provided with indicia in the form of discrete symbols, the apparatus comprising, in combination:

(A) input means associated with the reels of an amusement device for continuously detecting the position of each of the reels while the reels are rotating;

(B) computing means connected to the input means for receiving reel position signals from the input means and maintaining data on plural positions of each of the reels; and (C) comparator means connected to the computing means for receiving reel symbol signals from the computing means and comparing the symbols on each of the reels as a function of the position of the reels and determining if a predetermined match exists between the symbols of the reels;

the amusement device having a plurality of pay lines consisting of information indicating the position of the reels and the computing means including, in combination: index circuit means connected to the input means for receiving reel position data from the input means and processing the data received to determine a plurality of pay lines; and strip decode means connected to the index circuit means and to the comparator means for receiving a signal from the index circuit means and converting data contained in the signal into symbol outputs, decoded data being fed to the comparator means; the index circuit means including a plurality of position decode circuits, one such decode circuit to each of the reels, each position decode circuit comprising, in combination: counter means connected to the input means for receiving therefrom a signal which is a function of at least one position of an associated one of the rotatable reels;

shift register means connected to the counter means for storing current and prior reel position data; data selector means connected to the shift register means for routing data from the shift register means to the strip decode means; and binary decoder means connected to the data selector and to the strip decode means for converting binary signals received from the data selector means into a reel pay line signal.

7. Apparatus as defined in claim 6, wherein the input means includes, in combination:

sensing means associated with the reels for detecting the positions of the rotating reels; and pulse shaping means connected to the sensing means and to the computing means for receiving signals from the sensing means and conditioning these signals for input into the computing means.

8. Apparatus as defined in claim 7, wherein the sensing means includes sensor unit means arranged with respect to the associated reels for being pulsed by the rotation of the reels, interrupter means associated with the reels for actuating the sensor unit means as a function of symbols provided on the reels, and revolution indicating means associated witn the reels for actuating the sensor unit means with each revolution of the reels.

9. Apparatus as defined in claim 8 wherein a pair of sensor unit means is spaced apart a distance d/2 where d is the center to center spacing if adjacent interrupter means and the interrupter means are spaced such that no two sensor unit means are simultaneously actuated by the interrupter means.

10. Apparatus as defined in claim 9, wherein the sensor unit means comprises a plurality of radiation sensing units.

11. Apparatus as defined in claim 6 further including:

line select means connected to the index means for permitting selection of single or multiple pay lines for the determination of multiple lines and multiple odds wins.

12. Apparatus as defined in claim 11 further comprising pay means including:

counter means connected to the comparator means for processing data from the comparator means, and connected to a sensor of the gaming device, for determining presence of a win and completion of pay-out for a win, and;

pay control means connected to the pay counter means for receiving a signal from the pay counter means and actuating a hopper of an associated amusement device to effect a pay.

13. Apparatus as defined in claim 12, further comprising:

timing means connected to the pay means and computing means for coordinating functions of the control circuit.

14. Apparatus as defined in claim 13, wherein the timing means includes:

clock means for generating a pseudo-random pulse train for the indexing of the reels; and sequence means connected to the clock, to the computing means and to the pay means for coordinating all functions of the system and the associated gaming device, the clock means supplying clock pulses to the sequencing means.

* * * * *